US008596755B2

(12) United States Patent
Hibi

(10) Patent No.: US 8,596,755 B2
(45) Date of Patent: Dec. 3, 2013

(54) RECORDING APPARATUS

(75) Inventor: Manabu Hibi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 490 days.

(21) Appl. No.: 12/698,182

(22) Filed: Feb. 2, 2010

(65) Prior Publication Data

US 2010/0194801 A1 Aug. 5, 2010

(30) Foreign Application Priority Data

Feb. 4, 2009 (JP) ..... 2009-23560

(51) Int. Cl.
*B41J 2/165* (2006.01)

(52) U.S. Cl.
USPC ..... 347/33

(58) Field of Classification Search
USPC ..... 347/33
See application file for complete search history.

(56) References Cited

U.S. PATENT DOCUMENTS

| | | | |
|---|---|---|---|
| 6,419,343 | B1 | 7/2002 | Taylor et al. |
| 2005/0264603 | A1 | 12/2005 | Takagi |
| 2008/0218554 | A1 | 9/2008 | Inoue |

FOREIGN PATENT DOCUMENTS

| | | | | |
|---|---|---|---|---|
| EP | 1029681 | A1 | 8/2000 | |
| JP | 6-115083 | * | 4/1994 | ..... 347/33 |
| JP | 7-96604 | * | 4/1995 | ..... 347/33 |
| JP | 9201981 | A | 8/1997 | |
| JP | 10-258523 | | 9/1998 | |
| JP | 2000238277 | A | 9/2000 | |
| JP | 2004-291618 | * | 10/2004 | ..... 347/33 |
| JP | 2005-335303 | | 12/2005 | |
| JP | 2008221534 | A | 9/2008 | |

OTHER PUBLICATIONS

Notice of Reasons for Rejection for Japanese Patent Application No. 2009-023560 mailed Jan. 25, 2011.

* cited by examiner

*Primary Examiner* — Julian Huffman
(74) *Attorney, Agent, or Firm* — Banner & Witcoff, Ltd.

(57) ABSTRACT

A recording apparatus of the present invention includes: a droplet ejection head including an inflow passage, a common fluid passage, and a plurality of individual fluid passages each extending to an ejection opening; a supply mechanism capable of forcedly supplying a fluid to the inflow passage; a wiper made of an elastic material; and a moving mechanism which moves the wiper. The fluid forcedly supplied to the inflow passage and discharged from each ejection opening does not drop from the ejection face, and at least a predetermined amount of the fluid discharged from each ejection opening is retained on the ejection face when the wiper traverses the relevant ejection opening.

8 Claims, 18 Drawing Sheets

RECORDING APPARATUS

CROSS REFERENCE TO RELATED APPLICATION

The present application claims priority from Japanese Patent Application No. 2009-23560, which was filed on Feb. 4, 2009, the disclosure of which is herein incorporated by reference in its entirety.

BACKGROUND OF THE INVENTION

1. Field of the Invention

The present invention relates to a recording apparatus which records an image on a recording medium by ejecting droplets.

2. Description of the Related Art

An ink-jet head is known which has a common ink chamber connected to a supply port to which ink is supplied, and a plurality of individual ink passages each extending from an outlet of the common ink chamber to an ejection opening on an ejection face via a pressure chamber. This ink-jet head ejects ink droplets from the ejection openings by applying pulse-like pressure to ink inside each pressure chamber. Inside a nozzle of such an ink-jet head, which is an area of an individual ink passage nearby each ejection opening, ink inside a nozzle may be thickened or air bubbles or foreign materials may enter. This may lead to deterioration of the ink ejection characteristic. In view of this, there is known the following art. Namely, to remove the ink remaining on the ejection face, a pressurized ink is forcedly supplied from the supply port into the head to discharge from the ejection openings the thickened ink, air bubbles, or foreign materials along with the ink, and the ejection face is wiped with a wiper thereafter.

SUMMARY OF THE INVENTION

The above-mentioned art however requires a large amount of ink to be dropped from the ejection face, so as to discharge the thickened ink, air bubbles, or foreign materials from the ejection openings. As a result, an enormous amount of ink is wasted.

An object of the present invention is to provide a recording apparatus which requires a reduced amount of fluid discharged from the ejection openings, when discharging the thickened ink, air bubbles, or foreign materials from the ejection openings.

To achieve the foregoing object, a recording apparatus of the present invention includes a droplet ejection head, a supply mechanism, a wiper, a moving mechanism, and a controller. The droplet ejection head extends in one direction, and includes an inflow passage having an inflow port to which a fluid flows in, a common fluid passage connected to the inflow passage, and a plurality of individual fluid passages each extending from an outlet of the common fluid passage to an ejection opening formed on an ejection face via a pressure chamber. The supply mechanism is capable of forcedly supplying the fluid to the inflow passage. The wiper is made of an elastic material. The moving mechanism moves the wiper in the one direction while contacting the wiper to the ejection face. The controller controls the supply mechanism and the moving mechanism. The controller controls the supply mechanism and the moving mechanism so that the fluid forcedly supplied to the inflow passage and discharged from each ejection opening does not drop from the ejection face, and at least a predetermined amount of the fluid discharged from each ejection opening is retained on the ejection face when the wiper traverses the relevant ejection opening.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

First Embodiment (Printer)

Figure 1:
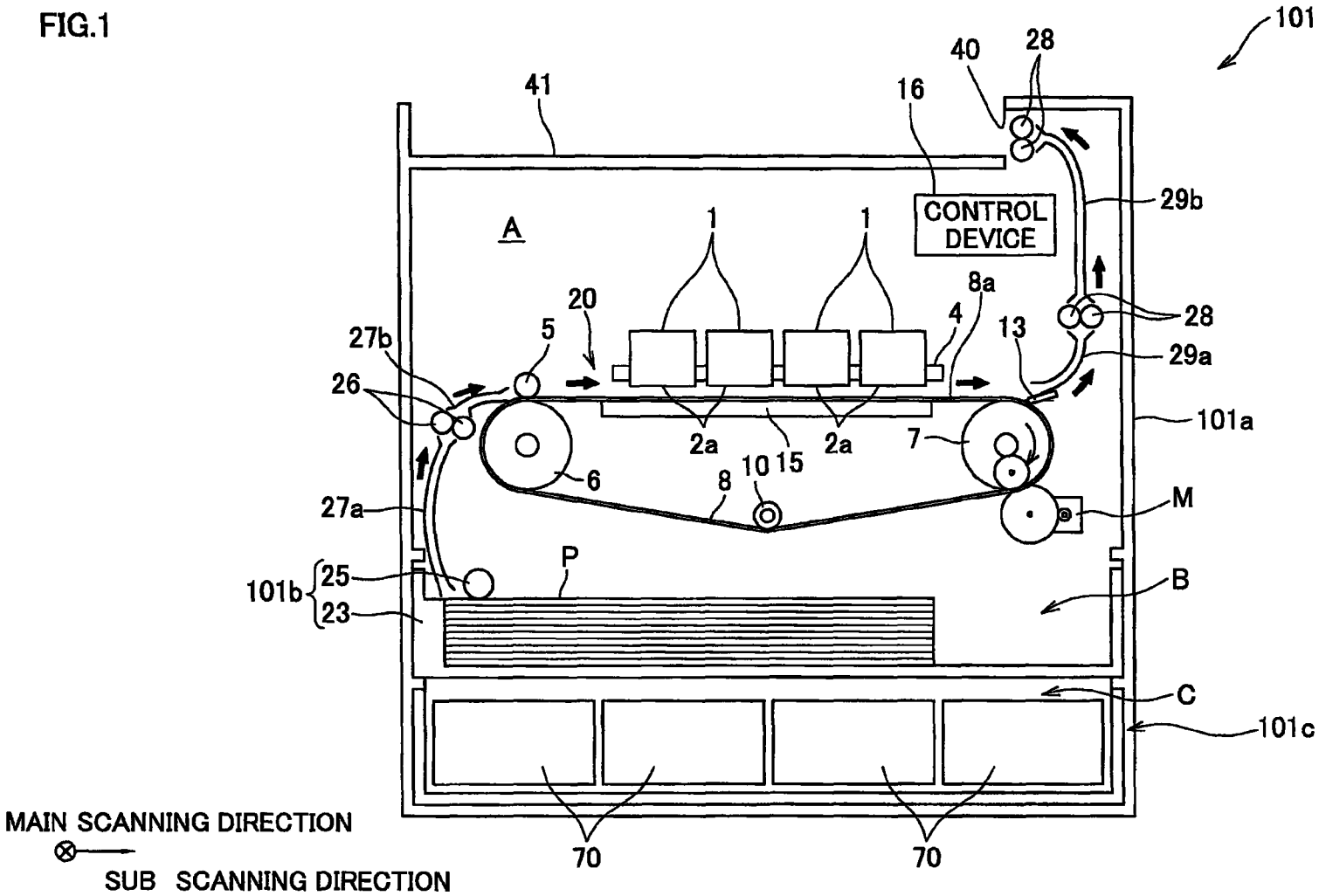
FIG. 1 is an exterior side view illustrating an ink-jet printer which is a recording apparatus of a first embodiment, according to the present invention.

As illustrated in FIG. 1, an ink-jet printer 101, i.e., a recording apparatus of a first embodiment of the present invention, has a casing 101*a* having a substantially rectangular parallelepiped shape. In the upper portion of the casing 101*a* is provided a sheet output unit 41. Further, the inside of the casing 101*a* is divided into three spaces A, B, and C sequentially from the top. In the space A are disposed: four ink-jet heads 1 which eject ink of Magenta, Cyan, Yellow, Black; a conveyance unit 20, and a maintenance unit 30 (see FIG. 9: the maintenance unit is hidden by the conveyance unit 20 in FIG. 1). The spaces B and C are spaces in which a sheet-feeder unit 101*b* and an ink tank unit 101*c* are disposed, respectively. The both of the sheet-feeder unit 101*b* and the ink tank unit 101*c* are detachable relative to the casing 101*a*. In the present embodiment, a sub scanning direction is a direction parallel to a conveyance direction in which a sheet P is conveyed by the conveyance unit 20. A main scanning direction is a direction of the horizontal plane which perpendicularly crosses the sub scanning direction. Further, the ink-jet printer 101 includes a control device 16 which controls the entire operation of the ink-jet printer 101 having the ink-jet head 1, the conveyance unit 20, and the maintenance unit 30.

Inside the ink-jet printer 101 is formed a conveyance path in which a sheet P is conveyed from the sheet-feeder unit 101*b* towards the sheet output unit 41 (bold arrow in FIG. 1). The sheet-feeder unit 101*b* has a sheet-feeder tray 23 capable of storing a plurality of sheets P, and a pickup roller 25 attached to the sheet-feeder tray 23. The pickup roller 25 feeds out the uppermost one of the plurality of sheets P stacked and stored in the sheet-feeder tray 23. The sheet P fed out by the pickup roller 25 is guided by the guides 27*a* and 27*b*, and sandwiched between a pair of feed rollers 26 and fed to the conveyance unit 20.

The conveyance unit 20 includes two belt rollers 6 and 7, an endless conveyor belt 8 looped around the both rollers 6 and 7, and a tension roller 10. The tension roller 10, at the lower part of the loop of the conveyor belt 8, is biased downward and contacts the inner circumference of the conveyor belt 8, thus adding tension to the conveyor belt 8. The belt roller 7 is a drive roller which is rotated clockwise in FIG. 1, by the drive force given from the conveyance motor M via two gears. The belt roller 6 is a driven roller which rotates clockwise in FIG. 1, as the conveyor belt 8 runs with the rotation of the belt roller 7.

The outer circumference 8*a* of the conveyor belt 8 is subjected to a silicone process (silicone resin layer formation process), and therefore has adhesiveness. In a position of the conveyance path facing the belt roller 6 across the conveyor belt 8 is disposed a nip roller 5. The nip roller 5 presses the sheet P having been fed out from the sheet-feeder unit 101*b* against the outer circumference 8*a* of the conveyor belt 8. With the adhesiveness on the outer circumference 8*a*, the sheet P pressed against the outer circumference 8*a* is conveyed towards right in FIG. 1 while being held on the outer circumference 8*a*.

In a position of the conveyance path facing the belt roller 7 across the conveyor belt 8 is provided a separation plate 13. The separation plate 13 separates the sheet P held on the outer circumference 8*a* of the conveyor belt 8 from the outer circumference 8*a*. The sheet P separated by the separation plate 13 is guided by the guides 29*a* and 29*b* and conveyed while being sandwiched between two pairs of feed rollers 28, and output to the sheet output unit 41 from the opening 40 formed in the upper portion of the casing 101*a*.

In the ink tank unit 101*c* provided in the space C are four ink tanks 70 in which ink to be supplied to the four ink-jet heads 1 is stored. The ink stored in each of the ink tanks 70 is supplied to the corresponding one of the ink-jet heads 1 by corresponding one of supply mechanism 69 illustrated in FIG. 2. Note that FIG. 2 only illustrates a single supply mechanism 69. However, there are four supply mechanisms 69 in total in the printer 101; one supply mechanism for one head 1.

As illustrated in FIG. 1, a platen 15 is disposed in the loop of the conveyor belt 8 so as to face the four ink-jet heads 1. The top face of the platen 15 contacts the inner circumference of an upper portion of the loop of the conveyor belt 8, to support the conveyor belt 8 from inside. With the platen 15, the outer circumference 8*a* of the upper portion of the loop of the conveyor belt 8 and the under surface of the ink-jet head 1, i.e., the ejection face 2*a*, face each other in parallel leaving a slight gap between the ejection face 2*a* and the outer circumference 8*a* of the conveyor belt 8. This gap structures a part of the conveyance path.

Further, the four ink-jet heads 1 are fixed to a not-illustrated frame and are arranged in one line in the conveyance direction. In short, the ink-jet printer 101 is a line printer. The frame is capable of ascending or descending along with the four ink-jet heads 1, by a not-illustrated elevation mechanism. As is later-mentioned, the control device 16 controls the elevation mechanism so that the four ink-jet heads 1 are selectively disposed in any one of the following positions: a "printing position" (see FIG. 1 and FIG. 11A), a "retracted position" (see FIG. 11B), and a "wiping position" (see FIG. 11C and FIG. 11D).

Figure 2:
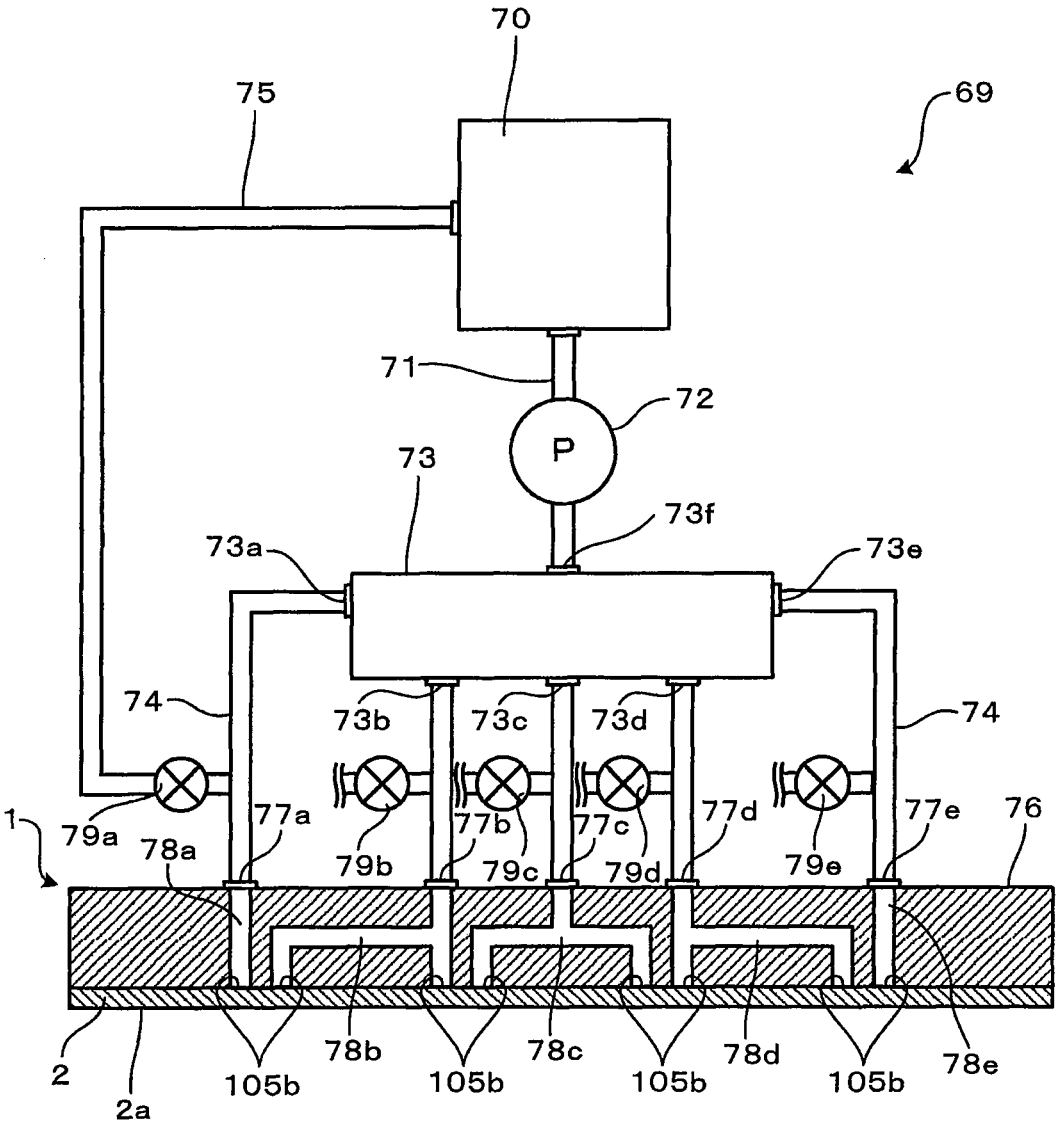
FIG. 2 is a side view illustrating a schematic structure of a supply mechanism for supplying ink to the ink-jet head in the printer illustrated in FIG. 1.

As illustrated in FIG. 2, each ink-jet head 1 has a reservoir unit 76 and a head main body 2 connected to the lower end of the reservoir unit 76. The reservoir unit 76 stores therein ink supplied from the supply mechanism 69, and supplies the ink to the head main body 2. Inside the reservoir unit 76 are formed five inflow passages 78*a* to 78*e*. Each of the inflow passages 78*a* and 78*e* is a passage with no branch. To the contrary, each of the inflow passages 78*b*, 78*c*, and 78*d* is a passage branching into two passages. The five inflow passages 78*a* to 78*e* extend from inflow ports 77*a* to 77*e* on the top face of the reservoir unit 76 to eight supply ports 105*b* on top face of the head main body 2, via a not-illustrated reservoir.

The head main body 2 has a rectangular parallelepiped shape which is long in the main scanning direction perpendicularly crossing the conveyance direction. The bottom face of the head main body 2 serves as the ejection face 2*a* facing the outer circumference 8*a* of the conveyor belt 8. When the sheet P conveyed on the conveyor belt 8 passes under the head main body 2 while the four ink-jet heads 1 are in the printing position, ink of different colors are sequentially ejected from the ejection faces 2*a* on to the top face of the sheet P, thereby forming a desirable color image on the sheet P.

(Head Main Body)

Figure 3:
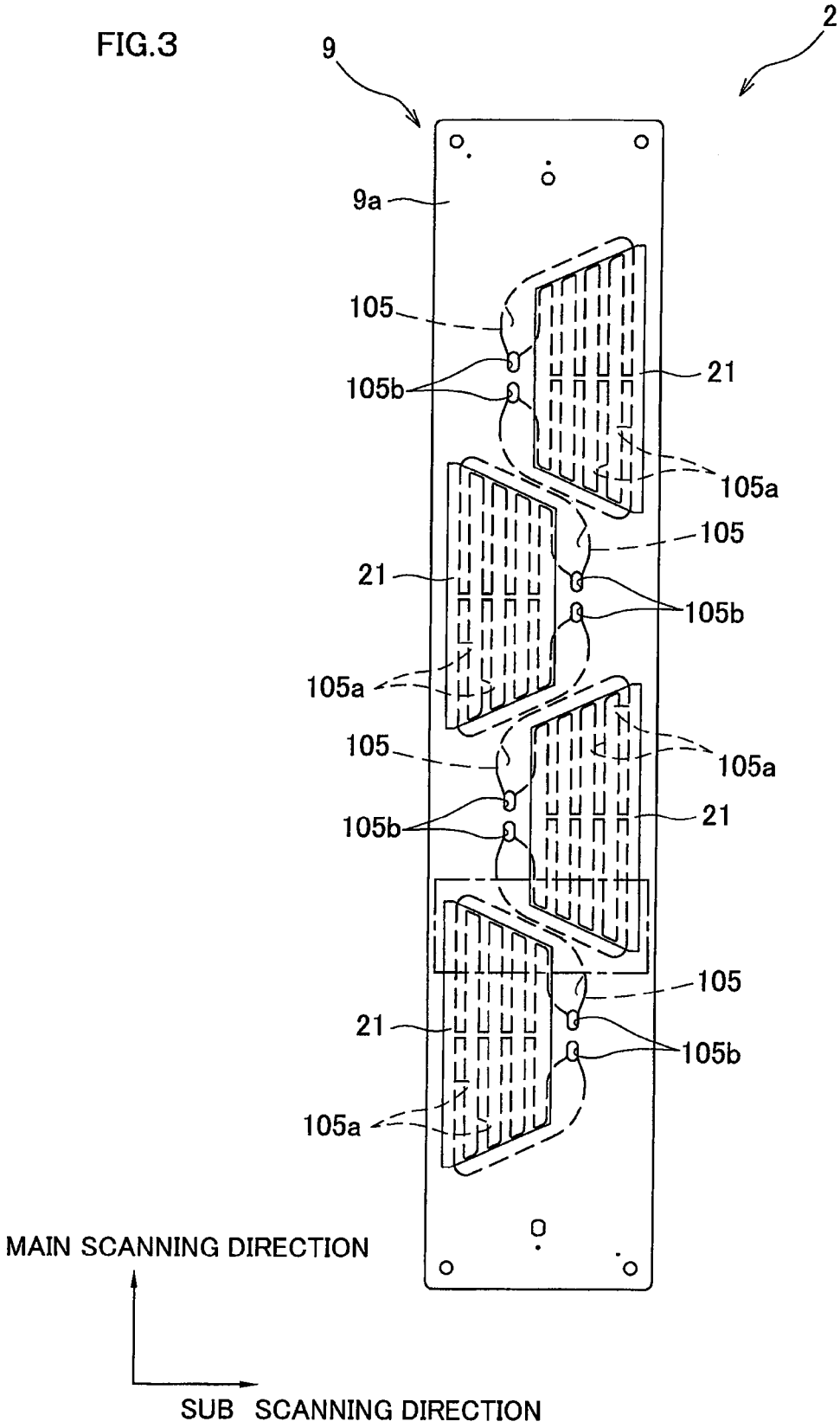
FIG. 3 is a plan view of an ink-jet head main body.
Figure 4:
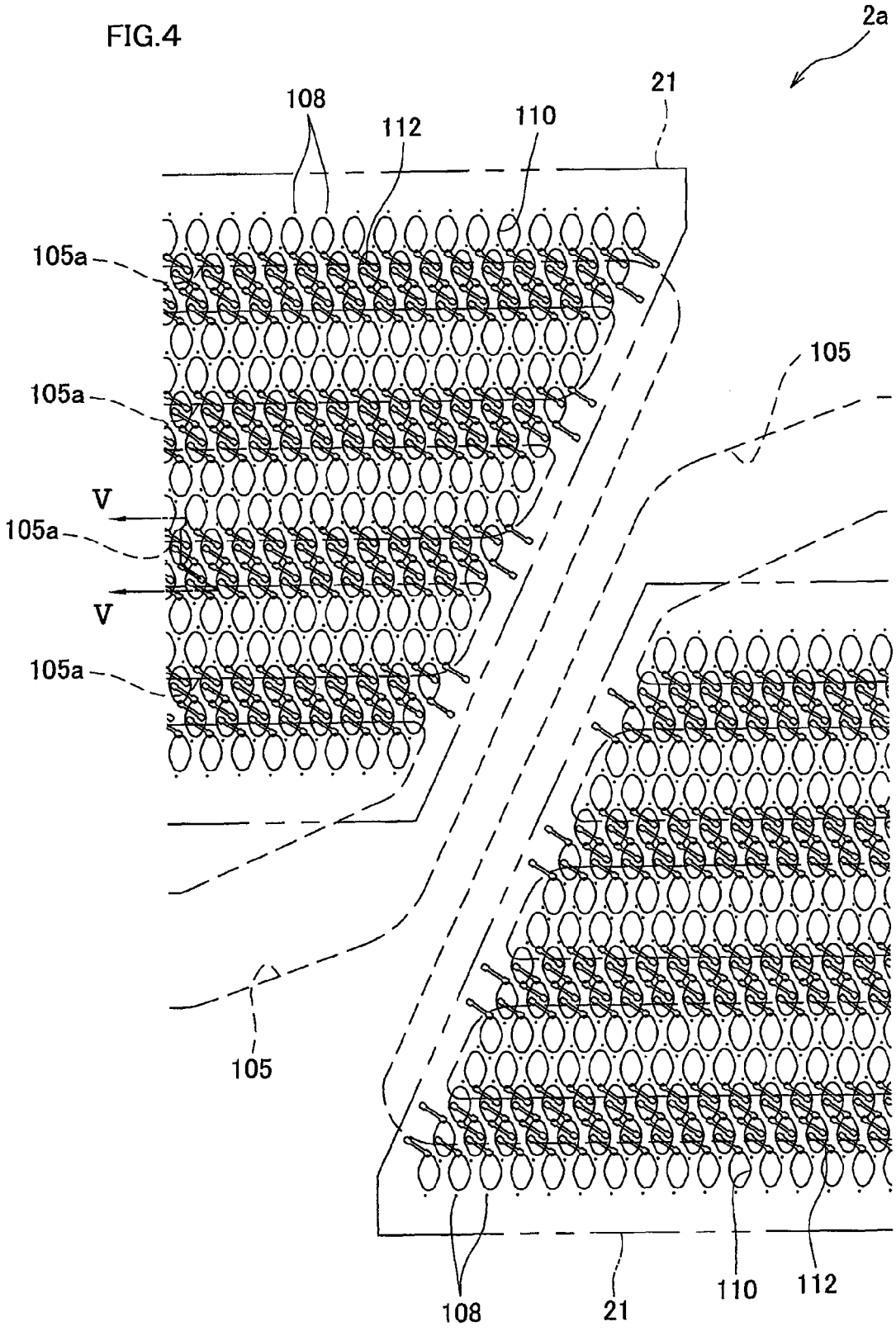
FIG. 4 is an enlarged view of an area circumscribed by the dashed line in FIG. 3.

As illustrated in FIG. 3, the head main body 2 has a passage unit 9, and four actuator units 21 each having a trapezoidal shape in plan view. The four actuator units 21 are fixed on a top face 9*a* of the passage unit 9. As illustrated in FIG. 4, inside the passage unit 9 are formed passages such as a plurality of manifold channels 105 and a plurality of pressure chambers 110. Note that FIG. 4 illustrates in solid lines the pressure chambers 110 and the apertures 112 under the actuator units 21, although these parts should be drawn in broken lines. Each actuator unit 21 includes a plurality of actuators each corresponding to one pressure chamber 110. Driving the actuator units 21 by a not-illustrated driver IC selectively gives ejection energy to the ink inside the pressure chambers 110.

As illustrated in FIG. 3, the passage unit 9 has a rectangular parallelepiped shape which is long in the main scanning direction. Inside the passage unit 9 are formed eight manifold channels 105 each of which is independent of one another. Each manifold channel 105 has one supply port 105*b* open on the top face 9*a* of the passage unit 9. In plan view, a large amount of each manifold channel 105 overlaps with the corresponding actuator unit 21. Under one actuator unit 21 are formed two manifold channels 105.

As illustrated in FIG. 2, two of the supply ports 105*b* on both ends of the passage unit 9 in the main scanning direction (later-mentioned wiping direction) are connected to inflow passages 78*a* and 78*e*, respectively. The other six supply ports 105*b* are connected to the three inflow passages 78*b* to 78*d* so that the three inflow passages 78*b* to 78*d* are each connected to two adjacent supply ports 105*b* out of the six supply ports 105*b*, sequentially in the main scanning direction.

Figure 12:
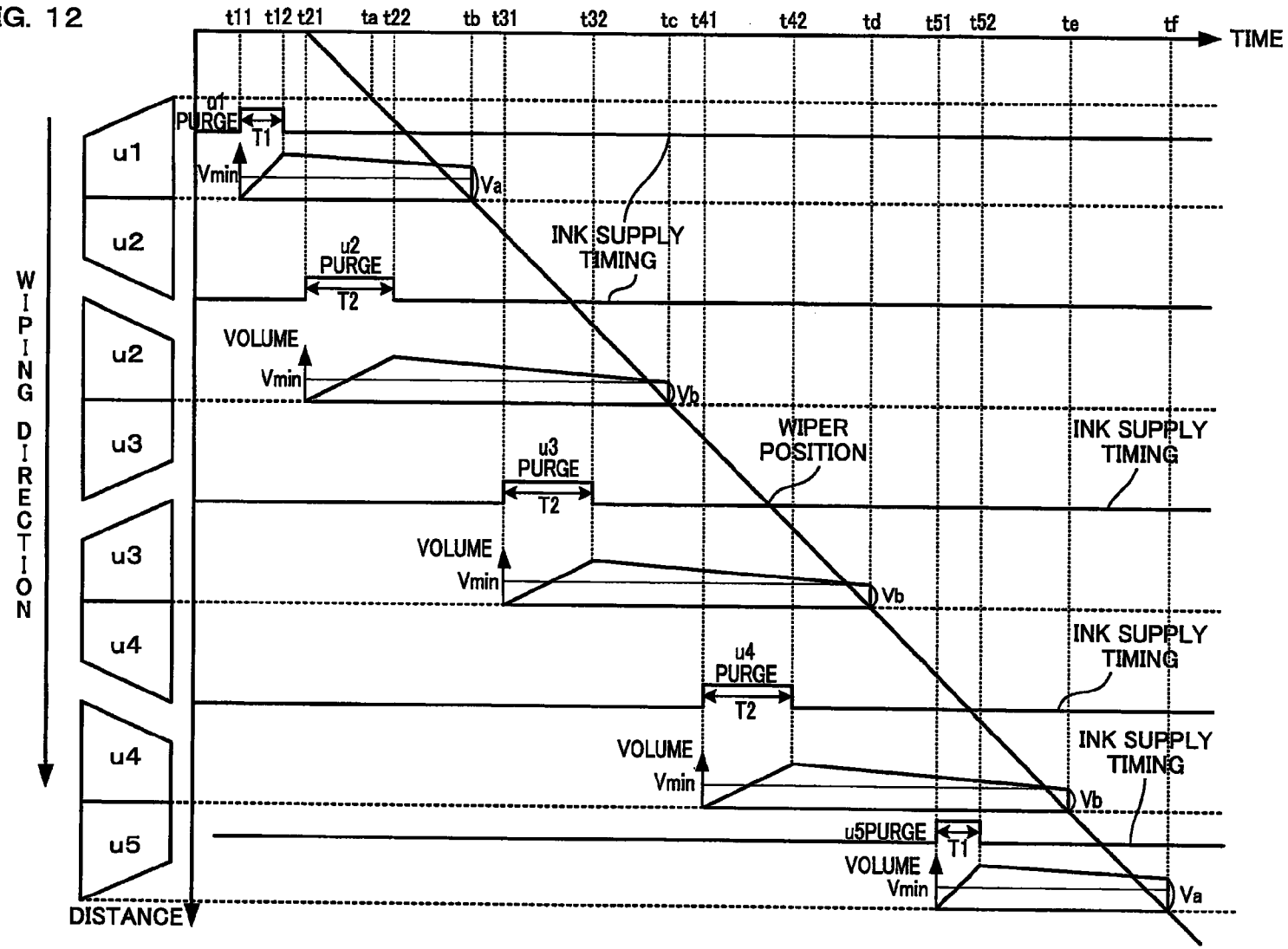
FIG. 12 is a time chart illustrating the relationship between the position of a wiper and the timing of the purge operation in each ejection area, in the first embodiment of the present invention.

In the present embodiment, each actuator unit 21 overlaps with two of the manifold channels 105 in plan view. These two manifold channels 105 are linearly symmetrical with respect to an imaginary straight line traversing in the sub scanning direction the midpoint of the actuator unit 21 relative to the main scanning direction. To these two manifold channels 105 are connected inflow passages (78*a*, 78*b*; 78*b*, 78*c*; 78*c*, 78*d*; 78*d*, 78*e*) that are different from one another. That is, the ejection face 2*a* are divided into five areas (hereinafter, ejection areas) by four imaginary lines. These five areas are hereinafter referred to as ejection areas, and are illustrated in FIG. 12 with reference numerals u1 to u5. Of these five ejection areas, each of three ejection areas in the middle overlaps with two adjacent actuator units 21. The manifold channels 105 relating to the five ejection areas communicate with the inflow passages 78*a* to 78*e* that are different from one another.

Each manifold channel 105 is branched into a plurality of sub manifold channels 105*a*. The plurality of sub manifold channels 105*a* extend parallel to one another in the main scanning direction. In the present embodiment, each manifold channel 105 is branched into four sub manifold channels 105*a*. Further as already mentioned, each actuator unit 21 overlaps with two manifold channels 105 in plan view. Therefore, each actuator unit 21 overlaps with eight sub manifold channels 105*a* in total in plan view. Each of these eight sub manifold channels 105*a* has an elongated shape which is long in the main scanning direction. With these eight sub manifold channels 105*a*, four lines are formed in the main scanning direction, each line being formed by two sub manifold channels 105*a*. Leading ends of two sub manifold channels 105*a* of a single line are slightly spaced in the main scanning direction. For example, this spacing distance corresponds to approximately 600 dpi.

The under surface of the passage unit 9 is the ejection face 2*a* having a plurality of ejection openings (openings at the leading ends of nozzles 131) 108 arranged in matrix. The plurality of pressure chambers 110 are also arranged in matrix as is the case of the ejection openings 108, on the surface of the passage unit 9 where the actuator units 21 are fixed.

In the present embodiment, each manifold channel 105 has sixteen arrays of pressure chambers 110, each array including equally distanced pressure chambers 110 arranged in the length direction of the passage unit 9. The number of pressure chambers 110 in each pressure chamber array is reduced from the wider side to the narrower side of the exterior shape (trapezoidal shape) of the actuator unit 21 so as to fit in the shape of the actuator unit 21. The ejection openings 108 are arranged in the similar manner. As illustrated in FIG. 4, each pressure chamber array is equally spaced from an adjacent array. On the other hand, the arrays of ejection openings 108 parallel to the pressure chamber arrays are formed so that no ejection openings 108 overlap with the sub manifold channel 105*a* in plan view. Therefore, the distance between adjacent arrays of ejection openings 108 are not necessarily the same.

Figure 5:
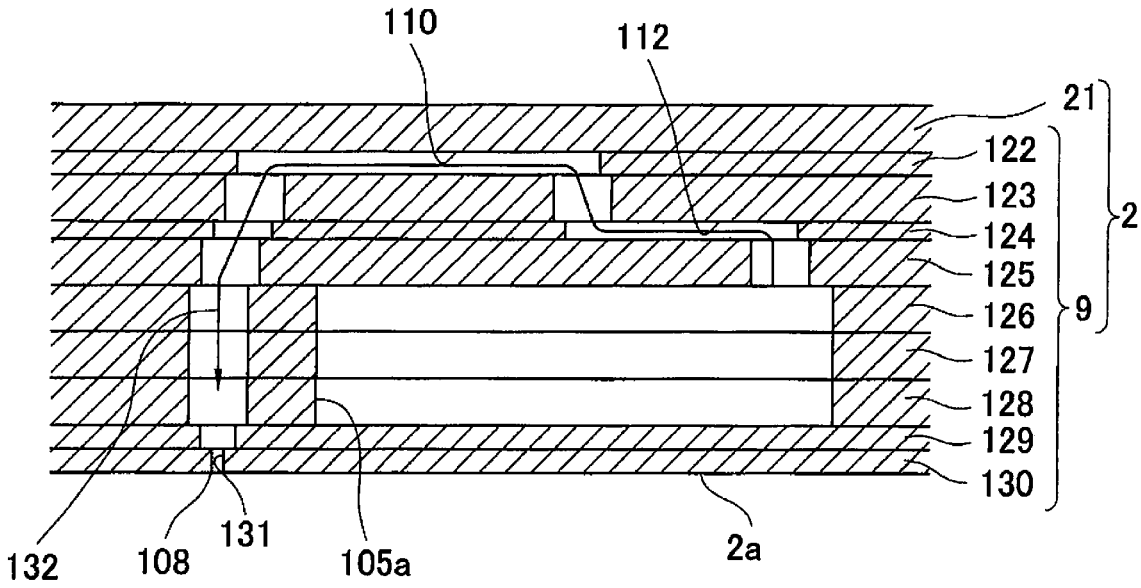
FIG. 5 is a cross sectional view taken along the line V-V in FIG. 4.

As illustrated in FIG. 5, the passage unit 9 is includes nine plates 122 to 130 made of a metal material such as stainless steel, or the like. These plates 122 to 130 have a rectangular plane shape which is long in the main scanning direction. Positioning and stacking these plates 122 to 130 form the passage unit 9.

A plurality of pressure chambers 110 are open on the top face 9*a* of the passage unit 9, i.e., the top face 9*a* of the plate 122. The openings are sealed by the four actuator units 21. On the other hand, the ejection face 2*a* of the passage unit 9, i.e., the under surface of the plate 130, the plurality of ejection openings 108 are formed. Each of the ejection openings 108 is an opening at the leading end of a nozzle 131. Each nozzle 131 is a through hole formed on the nozzle plate 130 in the thickness direction, and has a volume that corresponds to the maximum single ink droplet or approximately twice the maximum single ink droplet ejected from the ejection openings 108. In the present embodiment, the diameter of the ejection openings 108 is approximately 20 μm, and the volume of the nozzle 131 is approximately 50 pl. For example, the nozzle 131 has a truncated cone shape, and therefore a portion of the nozzle 131 closer to the ejection opening has a smaller diameter than a portion of the same farther from the ejection opening. Further, in the individual ink passage 132 described hereinbelow, the diameter of the nozzle 131 at the upstream end is varied in a non-continuous manner.

Next, the following describes a flow of ink in the passage unit 9. The ink supplied to the passage unit 9 from one of the five inflow passages 78*a* to 78*e* of the reservoir unit 76, via corresponding one or two of the eight supply ports 105*b*, is distributed to four sub manifold channels 105*a* of the corresponding manifold channel 105. The ink in the sub manifold channels 105*a* flows into the plurality of individual ink passages 132, and reaches the ejection openings 108 via the apertures 112 each serving as a throttle and the pressure chambers 110.

As is understood from this, the ink-jet head 1 includes five passage blocks defined by the inflow passage 78*a* to 78*e*, which blocks are independent of one another. Each passage block is structured with one of the five inflow passages 78*a* to 78*e*, one or two supply ports 105*b* connected to the corresponding one or two of the inflow passages 78*a* to 78*e*, one or two manifold channels 105 connected to the one or two supply ports 105*b*, and a plurality of individual ink passages 132 communicating with the one or two manifold channels 105.

Each ejection area mentioned above is an area that includes the plurality of ejection openings 108 related to one of the passage blocks on the ejection face 2*a*. Accordingly, the ejection face 2*a* includes the five ejection areas u1 to u5 (see FIG. 12) which are arranged in the main scanning direction. The five ejection areas u1 to u5 are close to each other in the main scanning direction without overlapping with one another. Each of the ejection areas u1 and u5 corresponds to an outer area which is one of two trapezoid portions obtained by bisecting the outermost one of the four actuator units 21 in the sub scanning direction. Each of three ejection areas u2, u3, and u4 is a combination of two inner trapezoid portions out of four trapezoid portions obtained by bisecting the two adjacent actuator units 21 in the sub scanning direction. Accordingly, the five ejection areas u1 to u5 are classifiable into two groups (i.e., u1 and u5; u2, u3, and u4) by the length of each area in the main scanning direction.

(Supply Mechanism)

The following describes the supply mechanisms 69, with reference to FIG. 2. Each supply mechanism 69 includes a pump 72, a diversion valve 73, a connection tube 71 connecting the ink tank 70 and the diversion valve 73, and five supply tubes 74. The pump 72 which pressurizes ink is attached to a midway portion of the connection tube 71. The diversion valve 73 has a supply port 73*f* to which ink is supplied from outside. The diversion valve 73 has five outlet ports 73*a* to 73*e* for outputting ink. Each of these outlet ports 73*a* to 73*e* is connected to the inflow ports 77*a* to 77*e* of the reservoir unit 76, via supply tubes 74, respectively. Ink inside the ink tank 70 is forcedly supplied to the reservoir unit 76 via the diversion valve 73, based on the control performed by a purge controller 84 (see FIG. 10) of the control device 16.

The supply mechanism 69 further includes five supply tubes 75, and five open/close valves 79*a* to 79*e*. Each supply tube 75 connects the ink tank 70 and the midway portion of the corresponding supply tube 74. As is hereinabove mentioned, the supply tube 74 is provided for each of the inflow ports 77*a* to 77*e*. Similarly, the supply tube 75 is also provided for each of the inflow ports 77*a* to 77*e*. In the present embodiment, the supply tube 75 is made available as five conduits that are independent of one another. However, the supply tube 75 may branch into five conduits from its midway portion. To these five supply tubes 75 are provided the open/close valves 79*a* to 79*e*, respectively. Open and close states of the open/close valves 79*a* to 79*e* are controlled by the control device 16.

(Diversion Valve)

Figure 6:
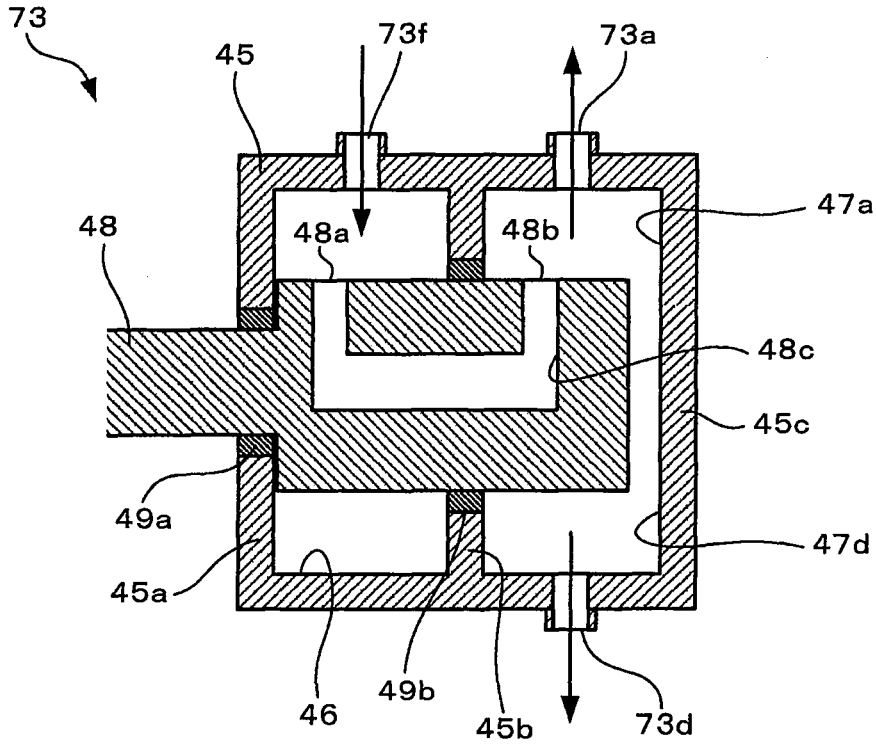
FIG. 6 is a cross sectional view of a diversion valve in the supply mechanism illustrated in FIG. 2.
Figure 7B:
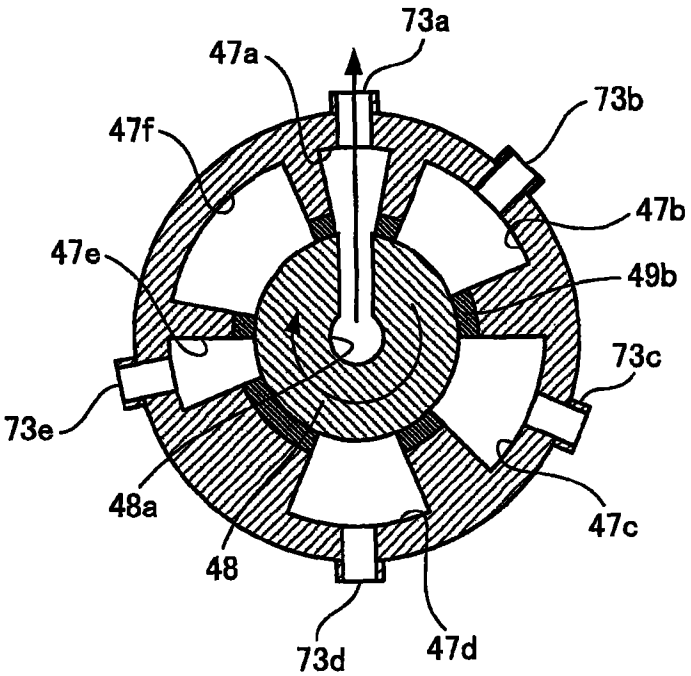
FIG. 7A, FIG. 7B, FIG. 8A and FIG. 8B are cross sectional views for explaining the operation of the diversion valve of FIG. 6.

The following describes the diversion valve 73, with reference to FIG. 6, FIG. 7A, FIG. 7B, FIG. 8A, and FIG. 8B. Note the positions of the outlet port 73*a* to 73*e* and the supply port 73*f* in FIG. 2 are different from those illustrated in FIG. 6, FIG. 7A, FIG. 7B, FIG. 8A, and FIG. 8B, for the sake of convenience in illustration. As illustrated in FIG. 6 and FIG. 7B, the diversion valve 73 includes a cylindrical casing 45 and a cylindrical rotator 48. The rotator 48 serves as a passage switching member disposed inside the casing 45. Inside the casing 45 are a first chamber 46 and six second chambers 47*a* to 47*f*. The first chamber 46 is separated from the six second chambers 47*a* to 47*f* by a wall 45*b* provided in the casing 45. The first chamber 46 is a cylindrical space is disposed on the left of the casing 45, and its inner circumference is the outer circumference of the rotator 48. Regardless of the position of the rotator 48, the first chamber 46 is not divided into two or more spaces. Further, the first chamber 46 communicates with the pump 72 and the ink tank 70, via the supply port 73*f* and the connection tube 71.

Each of the six second chambers 47*a* to 47*f* is a space having a fan-shaped transection, which is provided on the right half of the casing 45 in FIG. 6. These six second chambers 47*a* to 47*f* are arranged in this order about the center axis of the casing 45 in the circumferential direction. Between two of the second chambers 47*a* to 47*f* adjacent to each other is a partition extending in a radial direction. The second chambers 47*b*, 47*c*, 47*d*, 47*f* each has a volume which is approximately twice the volume of the second chamber 47*a* or 47*e*. These six second chambers 47*a* to 47*f* communicate with or be separated from one another, depending on the position of the rotator 48 relative to the axial direction. Of the six second chambers 47*a* to 47*f*, five second chambers 47*a* to 47*e* communicate with the inflow passages 78*a* to 78*e*, via the outlet ports 73*a* to 73*e* and the supply tube 74, respectively. The second chamber 47*f* on the other hand does not communicate with any passages outside the diversion valve 73.

In the present embodiment, there are two routes from the ink tank 70 to the inflow passages 78*a* to 78*e*: one of which is a route through the supply tube 75 and the supply tube 74; and another one of which is a route through the connection tube 71, diversion valve 73 (first chamber 46, second chambers 47*a* to 47*e*) and a supply tube 74.

A bearing 49*a* is mounted in an opening provided on a wall 45*a* on the left side of the casing 45 in FIG. 6. A bearing 49*b* is mounted in an opening provided on the wall 45*b* of the casing 45, on the wall 45*b* separating the first chamber 46 from the six second chambers 47*a* to 47*f*. The bearing 49*a* supports the shaft portion of the rotator 48, and the bearing 49*b* supports substantially the middle portion of the rotator 48. Further, nearby each of the bearings 49*a* and 49*b* is fixed a not-illustrated O-ring. Thus, the areas between the rotator 48 and the walls 45*a* and 45*b* are sealed.

The rotator 48 is capable of moving back and forth in the axial direction thereof, with an aid of a not-illustrated actuator. The rotator 48 may be selectively in one of "whole supply position (FIG. 6)" and "selective supply position (FIG. 7A)". The "whole supply position" is a position such that the left side surface of the rotator 48 abuts the inner surface of the wall on the left side of the casing 45, while the right side surface of the rotator 48 is apart from the inner surface of the wall on the right side of the casing 45. The "selective supply position" on the other hand is a position such that the left side surface of the rotator 48 is apart from the inner surface of the wall on the left side of the casing 45, while the right side surface of the rotator 48 abuts the inner surface of the wall on the right side of the casing 45. In the whole supply position, the wall 45*c* on the right side of the casing 45 and the rotator 48 are apart from each other, thus allowing a fluid to pass between the wall 45*c* and the rotator 48. The six second chambers 47*a* to 47*f* therefore are communicated with one another. On the other hand, in the selective supply position, the not-illustrated O-ring arranged on the right side surface of the rotator 48 seals the portion between the wall 45*c* and the rotator 48 so as to prevent a fluid from flowing between the wall 45*c* and the rotator 48. The six second chambers 47*a* to 47*f* therefore are separated from one another.

The rotator 48 is disposed to share the same axis as the casing 45, and is capable of rotating about the center axis of the casing 45. Inside the rotator 48 is formed a communication path 48*c*. Two ends of the communication path 48*c* respectively communicate with two openings 48*a* and 48*b* formed on the outer circumference of the rotator 48. The axial direction of the rotator 48 coincides with a direction connecting the two openings 48*a* and 48*b*. The opening 48*a* always faces the first chamber 46 regardless of the rotation position of the rotator 48. The opening 48*b* on the other hand faces one of the six second chambers 47*a* to 47*f*, according to the rotation position of the rotator 48. Accordingly, the communication path 48*c* communicates the first chamber 46 with one of the six second chambers 47*a* to 47*f* according to the rotation position of the rotator 48.

At the time of printing, the not-illustrated actuator is controlled by a later-described purge controller 84 so that the rotator 48 is disposed in the whole supply position. Then, the six second chambers 47*a* to 47*f* communicate with one another via the space created between the rotator 48 and the wall 45*c* on the right side of the casing 45. Further, the first chamber 46 communicates with the six second chambers 47*a* to 47*f* via the communication path 48*c*. Accordingly, a passage from the supply port 73*f* to the five outlet ports 73*a* to 73*e* is formed in the diversion valve 73. The pump 72 is stopped in a position that allows a flow of ink between the inlet and the outlet. Thus, ink which is not pressurized by the pump 72 is supplied from the ink tank 70 to all of the inflow passages 78*a* to 78*e* of the reservoir unit 76, via the pump 72 and the diversion valve 73. Further, the ink supplied to each of the inflow passages 78*a* to 78*e* is supplied to the manifold channels 105 and the individual ink passages 132. When the actuator unit 21 is driven and ink is ejected from the ejection openings 108, an amount of ink equal to the amount of ink consumed by that ejection is automatically refilled from the ink tank 70 to the ink-jet heads 1. The open/close valves 79*a* to 79*e* attached to the supply tube 75 may be in the open state or closed state at this time. The open/close valves 79*a* to 79*e* in the open state improve the ability of supplying ink from the ink tank 70 to the ink-jet heads 1 at the time of printing.

Figure 7A:
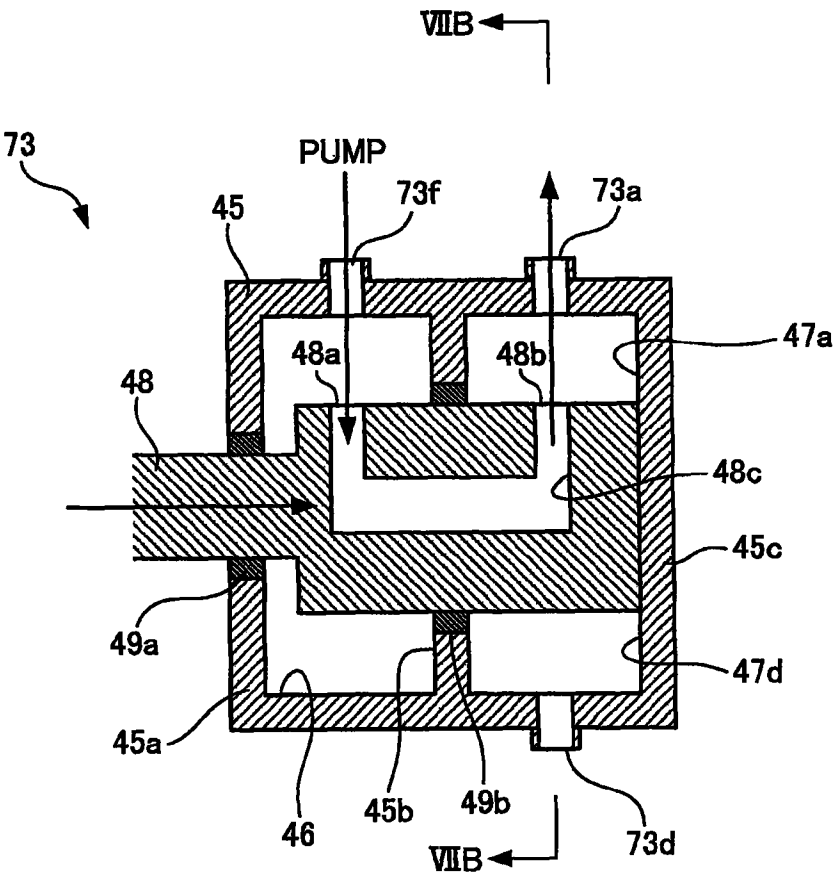

When purging, i.e., a maintenance work of the ink-jet heads 1, is performed, there is performed a purge operation in which ink pressurized by the pump 72 and forcedly supplied to the inflow passages 78*a* to 78*e* is discharged from the ejection openings 108. At the time of purging, the purge controller 84 turns all the open/close valves 79*a* to 79*e* to the closed state. The purge controller 84 further controls the not-illustrated actuator so that the rotator 48 is disposed in the selective supply position. The six second chambers 47*a* to 47*f* are then separated from one another as illustrated in FIG. 7A. As a result, the first chamber 46 communicates with only one of the six second chambers 47*a* to 47*e* (e.g. the second chamber 47*a*). That is, a passage from the supply port 73*f* to only one of the five outlet ports 73*a* to 73*e* (e.g. the outlet port 73*a*) is formed in the diversion valve 73. Driving the pump 72 during this state forcedly supplies pressurized ink from the ink tank 70 to only one of the five inflow passages 78*a* to 78*e* (e.g. inflow passage 78*a*) via the diversion valve 73. Thus, the pressurized ink (which may be thickened) is discharged along with the air bubbles or foreign materials in the head 1, from the ejection openings 108 in one of the five ejection areas u1 to u5 (e.g. ejection area u1). Note that, as is later-described, the pump 72 at this point is controlled so that the ink discharged from the ejection openings 108 in the purge operation remain on the ejection face 2*a*, i.e., the ink does not drop from the ejection face 2*a*.

Subsequently, the purge controller 84 controls the not-illustrated actuator so that the rotator 48 rotates clockwise in FIG. 7B, in sync with the movement of the later-mentioned wiper 51. Thus, a second chamber (47*a* to 47*f*) communicating with the first chamber 46 is switched in the following sequence: the second chamber 47*a*→the second chamber 47*b*→the second chamber 47*c*→the second chamber 47*d*→the second chamber 47*e* (→the second chamber 47*f*); i.e., in sequence corresponding to the arrangement of the five ejection areas u1 to u5.

When the opening 48*b* faces a partition which separates any two of the second chambers 47*a* to 47*f* adjacent to each other at the time of switching the second chamber (47*a* to 47*f*) communicating with the first chamber 46, the first chamber 46 is non-communicated state in which the first chamber 46 does not communicate with any of the second chambers 47*a* to 47*f*. At the timing of transition to this non-communicated state, the purge controller 84 turns to the open state one of the open/close valves 79*a* to 79*e* (e.g. open/close valve 79*a*) corresponding to the second chamber (47*a* to 47*e*) having communicated with the first chamber 46 immediately before the transition. Thus, the ink tank 70 is directly communicated, via the supply tube 75, with the ejection openings 108 in an ejection area (u1 to u5) corresponding to the second chamber (47*a* to 47*e*) having communicated with the first chamber 46 immediately before the transition to the non-communicated state. Accordingly, a negative pressure corresponding to the difference in the hydraulic heads between the ink-jet head 1 and the ink tank 70 acts on the ink on the ejection face 2*a*. Thus, when the transition to the non-communicated state occurs, the ink on the ejection face 2*a* in the ejection area (u1 to u5) corresponding to the second chamber (47*a* to 47*e*) having communicated with the first chamber 46 immediately before the transition is sucked back into the nozzles 131 due to the negative pressure.

With the five second chambers 47*a* to 47*e* sequentially communicating with the first chamber 46, ink pressurized by the pump 72 is forcedly supplied from the ink tank 70, via the diversion valve 73, to the inflow passages 78*a* to 78*e* in the following sequence: the inflow passage 78*a*→the inflow passage 78*b*→the inflow passage 78*c*→the inflow passage 78*d*→the inflow passage 78*e*. With this, the ejection area (u1 to u5) with the ejection openings 108 discharging the pressurized ink is switched in the following sequence: the ejection area u1→the ejection area u2→the ejection area u3→the ejection area u4→the ejection area u5 (see FIG. 12). The timing of starting and stopping the supply of ink to the inflow passages 78*a* to 78*e* is determined according to the positional relationship of the second chambers 47*a* to 47*e* and the rotating speed of the rotator 48. As is already mentioned, the non-communicated state occurs when switching the second chamber (47*a* to 47*f*) communicating the first chamber 46. Every time this non-communicated state occurs, the purge controller 84 sequentially turns to the open state the open/close valve (79*a* to 79*e*) corresponding to the second chamber (47*a* to 47*e*) having communicated with the first chamber 46 immediately before the transition. With the transition to the open state, the ink once being discharged and retained on the ejection face 2*a* starts to go back inside the nozzle 131.

Figure 8B:
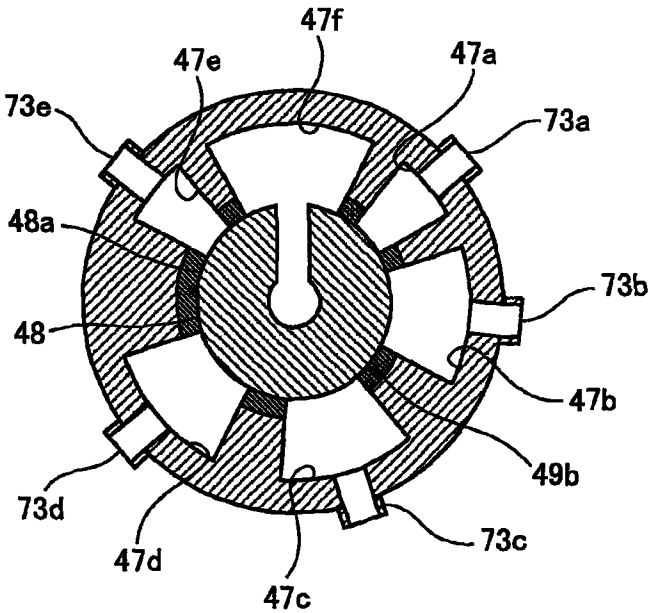
Figure 8A:
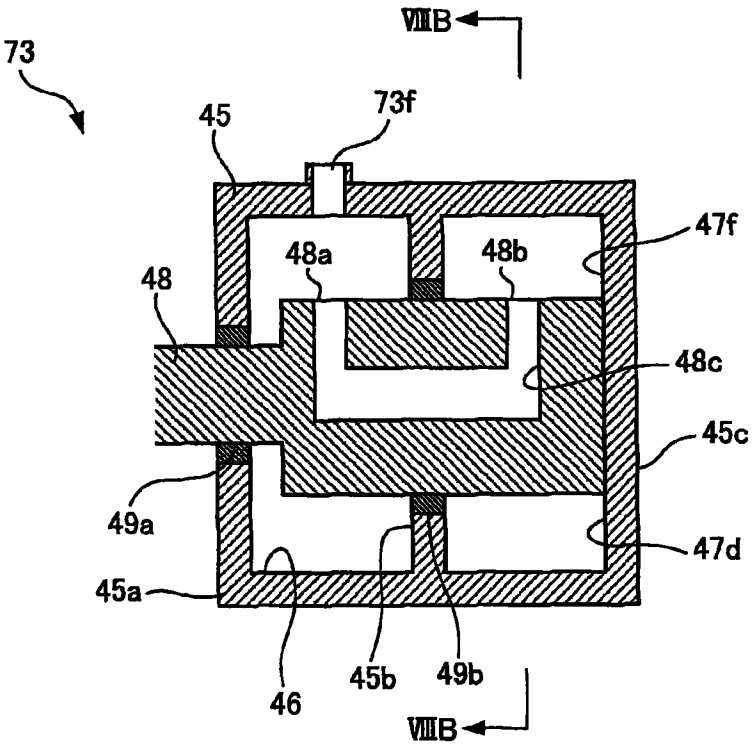

Further, when the rotator 48 is rotated clockwise in FIG. 7B so that the first chamber 46 communicates with the second chamber 47*f* as is illustrated in FIG. 8A and FIG. 8B (the casing 45 is rotated instead of the rotator 48 in these figures), there will be no passage communicating the supply port 73*f* with any one of the five outlet ports 73*a* to 73*e*, in the diversion valve 73. Ink pressurized by the pump 72 therefore is not forcedly supplied to any one of the inflow passages 78*a* to 78*e*. All the ejection openings 108 therefore stop discharging ink. When the second chamber in communication with the first chamber 46 is switched from the second chamber 47*e* to the second chamber 47*f*, there is a period of non-communicated state as is the case of switching to other second chamber. During this non-communicated state, the open/close valve 79*e* is turned to the open state by the purge controller 84. At this time, the ink discharged from the ejection area u5 and retained on the ejection face 2*a* starts to go back inside the nozzle 131.

The open/close valves 79*a* to 79*e* having been turned to the open state during the purge operation may be kept in the open state even after completion of the purge operation, or turned back to the closed state. When the open state is maintained, the ability of supplying ink to the ink-jet heads 1 is improved, and air bubbles which cause problems in ejection do not remain/grow in the supply tubes 75 including the open/close valves 79*a* to 79*e*.

(Maintenance Unit)

Figure 9:
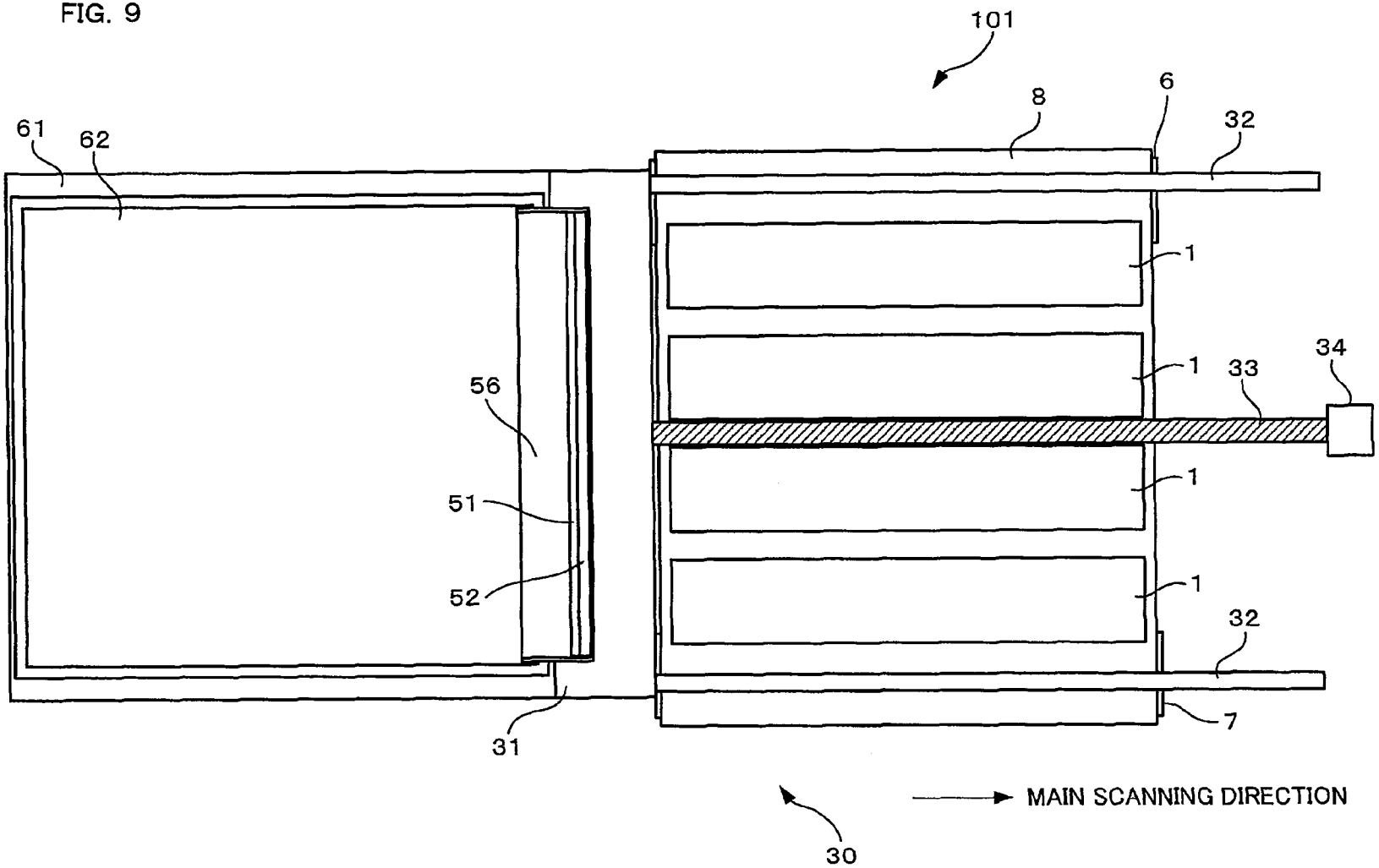
FIG. 9 is a plan view schematizing the ink-jet printer of FIG. 1.
Figure 11A:
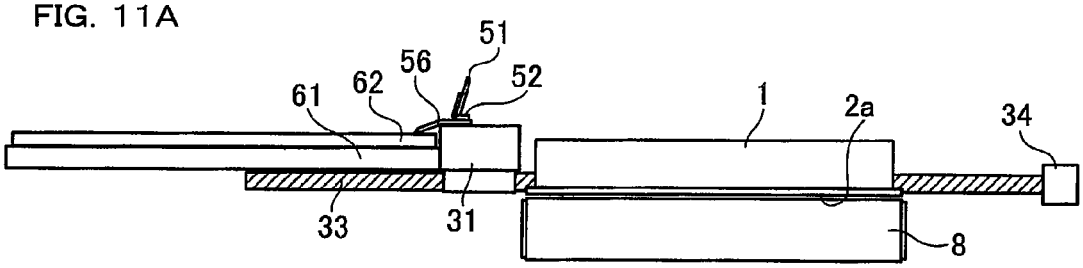
FIG. 11A to FIG. 11D are side views sequentially illustrating a maintenance operation of the maintenance unit in the first embodiment of the present invention.

Next, the following describes the maintenance unit 30 with reference to FIG. 9 and FIG. 11A. The maintenance unit 30 performs maintenance work for the ink-jet heads 1, and includes an X-stage 31 capable of moving in the main scanning direction, a wiper 51, a holder 52 supporting the wiper 51, a discharge guide 56, a moving tray 61 which is a rectangular plate member fixed on the left end of the X-stage 31, and a waste ink tray 62 disposed on the moving tray 61. The waste ink tray 62 has a size that covers the four ink-jet heads 1 in plan view, when disposed in a later-mentioned ink receiving position (see FIG. 11C).

The X-stage 31 extends in the sub scanning direction which is the arrangement direction of the four ink-jet heads 1, so as to face the four ink-jet heads 1 in plan view. The X-stage 31 is slidably supported nearby its two ends relative to the arrangement direction, by a pair of guide rails 32 extending in the main scanning direction. To a lower portion nearby the midpoint of the X-stage 31 is screwed a ball screw 33 extending parallel to the guide rails 32. An end portion of the ball screw 33 is connected to a maintenance motor 34. When the maintenance motor 34 is driven and the ball screw 33 is thus rotated, the X-stage 31 is able to move back and forth in the main scanning direction, along with the moving tray 61 and the waste ink tray 62. The maintenance motor 34 is controlled by the control device 16.

The wiper 51 is a rectangular blade made of an elastic material such as rubber or resin, and is for wiping the ejection face 2*a*. The wiper 51 is wider than the entire width of the four ink-jet heads 1 in the arrangement direction. The wiper 51 is tilted at a predetermined angle with respect to the ejection face 2*a*. The holder 52 is fixed on the top face of the X-stage 31. The holder 52 supporting the wiper 51 is fixed on the X-stage 31, and therefore the wiper 51 moves in the main scanning direction with the X-stage 31. As is later-described, the direction of the wiper 51 wiping the ejection face 2*a* is a direction from the left to right of the FIG. 9.

The discharge guide 56 is fixed on the top face of the X-stage 31 along with the holder 52, and has a slope tilted downwardly from the lower end of the wiper 51 towards the waste ink tray 62. Thus, the ink wiped from the ejection face 2*a* by the wiper 51 flows from the wiper 51 towards the waste ink tray 62 along the slope.

(Control Device)

Figure 10:
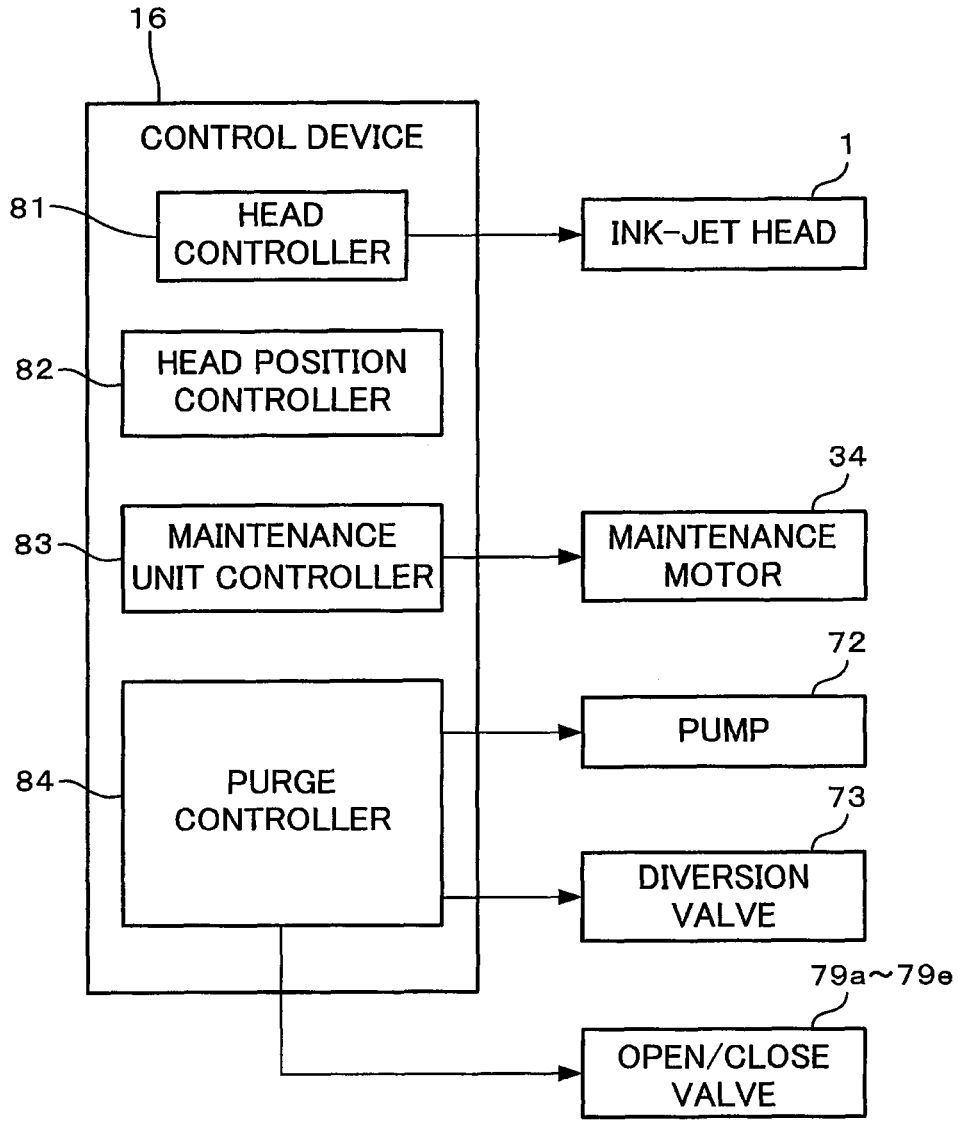
FIG. 10 is a block diagram of a control device inside the printer illustrated in FIG. 1.

Next, the control device 16 is described with reference to FIG. 10. The control device 16 includes: a CPU (Central Processing Unit); an EEPROM (Electrically Erasable and Programmable Read Only Memory) storing in a rewritable manner a program run by the CPU and data for use in the program; and RAM (Random Access Memory) which temporarily stores data while the program is running. The functional parts structuring the control device 16 are build by the EEPROM and the software in the hardware cooperating with each other.

The control device 16 has a head drive controller 81, a head position controller 82, a maintenance unit controller 83, and a purge controller 84. The head drive controller 81 controls the ink-jet heads 1 by driving the actuator unit 21 through the driver IC. The head position controller 82 controls a not-illustrated elevation mechanism so that the four ink-jet heads 1 are disposed in any of a printing position, a retracted position, and a wiping position. The maintenance unit controller 83 controls driving of the maintenance motor 34, so as to control the movement of the maintenance unit 30 including the wiper 51 and the waste ink tray 62 in the main scanning direction.

The purge controller 84 controls the pump 72, and the diversion valves 73 and the open/close valves 79*a* to 79*e* at the time of purging, so as to perform an ink supply operation to the heads 1. The purge controller 84 controls the pump 72 and the diversion valves 73 so that ink pressurized by the pump 72 is forcedly and sequentially supplied to the five inflow passages 78*a* to 78*e*. With this, the pressurized ink is discharged sequentially from the ejection openings 108 in the five ejection areas u1 to u5. Further, the purge controller 84 sequentially turns to the open state one of the open/close valves 79*a* to 79*e*, every time the non-communicated state occurs during the purge operation.

(Maintenance Operation)

Next, the following describes the maintenance operation of the ink-jet heads 1. The maintenance operation includes the purge operation which discharges ink pressurized by the pump 72 and forcedly supplied to the inflow passages 78*a* to 78*e*; and a wipe operation which wipes ink adhered to the ejection face 2*a* in the purge operation. Through the purge operation, thickened ink, the air bubbles, or the foreign materials inside the passage is/are discharged from the ejection openings 108. Performing the wipe operation in sync with the purge operation allows removal of the adhered ink from the ejection face 2*a*. This maintenance of the ink-jet heads 1 is performed in occasions such as: when the ink-jet printer 101 is powered; after elapse of a predetermined period since powering of the ink-jet printer 101; before the start of printing; when a user enters an instruction; or the like.

As illustrated in FIG. 11A, at a time of printing, the ink-jet heads 1 are disposed in the printing position such that a predetermined space is formed between the ejection face 2*a* and the outer circumference 8*a* of the conveyor belt 8. The waste ink tray 62 on the other hand is dispose in the standby position where the trays 62 faces none of the ejection faces 2*a* of the four ink-jet heads 1. The standby position is on the left side of and adjacent to the ink-jet heads 1 in the main scanning direction.

Figure 11B:
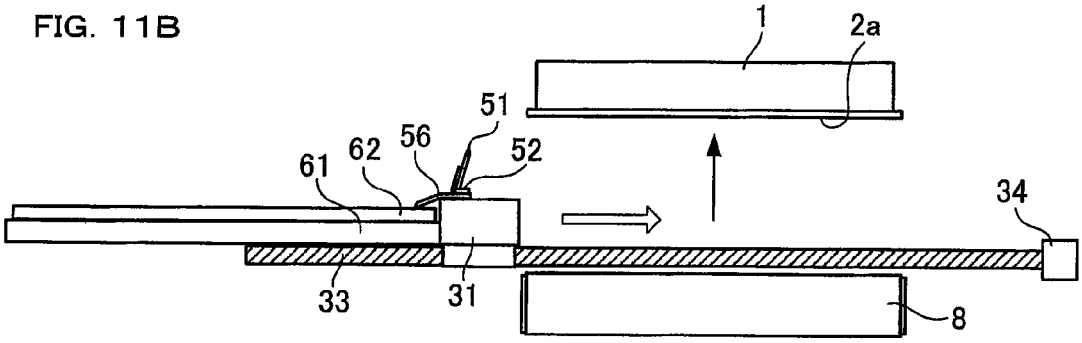

When the maintenance operation of ink-jet heads 1 is started, the head position controller 82 controls the elevation mechanism to move the ink-jet heads 1 to the retracted position in which the ejection faces 2*a* are positioned higher than the leading ends of the wiper 51, as illustrated in FIG. 11B. Then, the maintenance unit controller 83 controls the maintenance motor 34 to move the X-stage 31 rightward so that the waste ink tray 62 is disposed in the ink receiving position to face the ejection faces 2*a* of the four ink-jet heads 1. At this point, the ink-jet heads 1 are disposed in the retracted position, and therefore the leading end of the wiper 51 does not contact the ejection faces 2*a*.

Figure 11C:
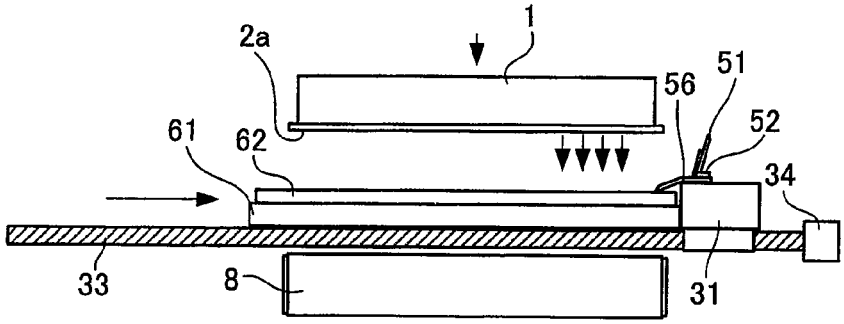

When the waste ink tray 62 is disposed in the ink receiving position, the head position controller 82 controls the elevation mechanism to move the ink-jet heads 1 to the purging position which is between the retracted position and the printing position. When the ink-jet heads 1 are in the purging position, the ejection faces 2*a* are positioned slightly lower than the leading end of the wiper 51, as illustrated in FIG. 11C. The wiper 51 therefore contacts the ejection faces 2*a*.

Figure 11D:
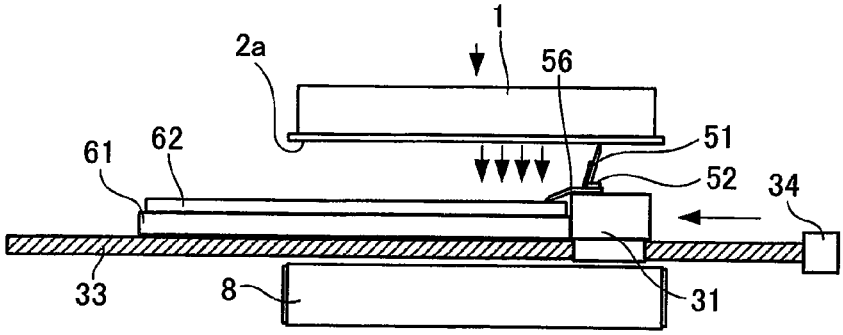

Then, as illustrated in FIG. 11D, the purge operation and the wipe operation are conducted while moving the maintenance unit 30 leftward.

The purge operation and the wipe operation are described below with reference to FIG. 12. In FIG. 12, the longitudinal axis represents the position of the wiper 51 in the wiping direction, in relation to the five ejection areas u1 to u5. The transverse axis on the other hands represents time. The straight line extending from the upper left towards lower right of FIG. 12 shows the position of the wiper 51. The upper part of the graph shows the periods in which the ejection areas u1 to u5 discharge pressurized ink from their ejection openings 108 during the purge operation. The lower part of the graph shows changes in the amount of ink discharged from one ejection opening 108 in an ejection area (u1 to u5) which is not yet wiped by the wiper 51, and retained on the ejection face 2*a*. Note that the lower part of the graph indicates changes in the amount of ink at one of the plurality of ejection openings 108 in an ejection area (u1 to u5), which is at the downstream end of the ejection area (u1 to u5) relative to the wiping direction. Changes in the amount of ink at other ejection openings 108 are the same as the changes indicated in FIG. 12 except in that the amount of ink comes to zero, when the wiper 51 traverses the relevant ejection openings 108.

The following describes the purge operation. When the ink-jet heads 1 are disposed in the purging position, the purge controller 84 turns all the open/close valves 79*a* to 79*e* to the closed state. Further, the purge controller 84 controls the diversion valves 73 and the pump 72 to perform the purge operation which discharges ink pressurized by the pump 72 and forcedly supplied to the inflow passages 78*a* to 78*e* from the ejection openings 108 in each of the ejection areas u1 to u5. This purge operation is performed with respect to each ejection area from the upstream to the downstream relative to the wiping direction, by forcedly supplying ink to the five inflow passages 78*a* to 78*e* in sequence corresponding to the arrangement of the ejection areas u1 to u5. That is, the purge operation is performed with respect to the ejection areas u1 to u5 in the following sequence: the ejection area u1→the ejection area u2→the ejection area u3→the ejection area u4→the ejection area u5. From one aspect, the drive periods (T1, T2) of the pump 72 are determined by the control device 16 so that, where the rotating speed of the pump 72 is constant, the ink discharged from all the ejection openings 108 in any ejection area does not drop and is retained on the ejection face 2*a* by the surface tension.

Specifically, the purge operation controller 84 turns the open/close valves 79*a* to 79*e* to the closed state. The supply tube 75 therefore is blocked. The purge controller 84 controls the not-illustrated actuator so as to move the rotator 48 to the selective supply position and rotate the same clockwise in FIG. 7B at an equiangular velocity. With this, the first chamber 46 communicates the second chamber 47*a*, and a passage from the supply port 73*f* to the outlet port 73*a* is formed in the diversion valve 73. The angular velocity of the rotator 48 is determined so that the first chamber 46 and a second chamber (47*a* to 47*e*) starts to communicate with each other from the start time of the drive period (T1, T2) of the pump 72 until the end time of the drive period (T1, T2) of the pump 72. When the passage is formed, the purge controller 84 drives the pump 72 during the drive period T1 and supplies the pressurized ink to the inflow passage 78*a* via the diversion valve 73. The pressurized ink is then discharged from the ejection openings 108 of the ejection area u1 (t11 to t12). The ink discharged does not drop, and is retained on the ejection face 2*a* by the surface tension.

Since the rotator 48 is rotating, the second chamber (47*a* to 47*e*) communicating with the first chamber 46 is switched in sequence, as is already described. Ink therefore is forcedly supplied to inflow passages 78*b* to 78*e* via the outlet ports 73*a* to 73*e* sequentially. With the above operation, the ejection area (u2 to u5) with the ejection openings 108 discharging the pressurized ink is switched.

Ink pressurized by the pump 72 is forcedly supplied to the inflow passages 78*a* to 78*e* during the drive periods of the pump 72, i.e., a period from t11 to t12, a period from t21 to t22, a period from t31 to t32, a period from t41 to t42 and a period from t51 to t52. Therefore, as is shown in the lower parts of the graphs in relation to each of the ejection areas u1 to u5, the amount of ink retained on the ejection face 2*a* of each ejection opening 108 increases with elapse of time. The pump 72 rotates at a constant rotating speed during the five drive periods. Therefore, a constant amount of ink is forcedly supplied to the inflow passages 78*a* to 78*e* in each unit time period. On the other hand, the number of ejection openings 108 in each of the ejection areas u1 and u5 is about a half of the number of ejection openings 108 in each of the other ejection areas u2 to u4. For this reason, the amount of ink discharged from each ejection opening 108 in a unit time period (i.e., the rate of change in the discharge amount) in the period T1 (the period from t11 to t12, the period from t51 to t52) where ink is forcedly supplied to the ejection areas u1 or u5 is greater than (theoretically twice) the amount of ink discharged from each ejection opening 108 in a unit time period in the period T2 (the period from t21 to t22, the period from t31 to t32, and the period from t41 to t42) where ink is forcedly supplied to the other ejection area (u2 to u4). Therefore, to equalize the amount of ink discharged from each ejection opening 108 of every ejection area until the end of the drive period, the drive period (T1) related to the two ejection areas u1 and u5 is made shorter than (theoretically, a half of) the drive period (T2) related to three other ejection areas u2, u3, and u4. Suppose the head 1 has an ejection area having a different length from those of the ejection areas u1 to u5. Then, the drive period of the pump 72 related to the relevant ejection area needs to be adjusted proportionally to the length of the relevant ejection area.

When the second chamber (47*a* to 47*f*) communicating with the first chamber 46 is switched, the non-communicated state occurs every time the opening 48*b* faces a partition separating any two adjacent second chambers (47*a* to 47*f*), and during the state, the first chamber 46 does not communicate with any of the second chambers 47*a* to 47*f*. This non-communicated state occurs during the period from t12 to t21, the period from t22 to t31, the period from t32 to t41, the period from t42 to t51, and a predetermined period starting from t52. The open/close valves 79*a* to 79*e* are sequentially turned to the open state every time the non-communicated state occurs. At this time, the difference in the hydraulic head causes negative pressure in the nozzle 131. Due to this negative pressure, the ink retained on the ejection face 2*a* is gradually sucked back inside the nozzle 131 from each ejection opening 108. The amount of ink outside each ejection opening 108 therefore is gradually reduced.

At the end of the non-communicated state immediately after the state where the first chamber 46 communicates with the second chamber 47*e*, the first chamber 46 communicates with the second chamber 47*f* (see FIG. 8A and FIG. 8B). In other words, no passage is formed between the supply port 73*f* and any of the five outlet ports 73*a* to 73*e*. At this point the purge operation ends.

Next, the following describes the wipe operation performed in sync with the purge operation. While the leading end of the wiper 51 contacts the ejection face 2*a*, the maintenance unit controller 83 moves the X-stage 31 from the right to the left of FIG. 11D so that the wiper 51 sequentially wipes the ejection areas u1 to u5 in the wiping direction, in sync with the switching one of the five inflow passages 78*a* to 78*e* targeted for the ink supply. The wiper 51 abuts the ejection face 2*a* at upstream of the ejection area u1 (at t21) and moves at an equal speed. The wiper 51 sequentially traverses the ejection openings 108 of the ejection area u1 during a period from ta to tb, the ejection openings 108 of the ejection area u2 during a period from tb to tc, the ejection openings 108 of the ejection area u3 during a period from tc to td, the ejection openings 108 of the ejection area u4 during a period from td to te, and the ejection openings 108 of the ejection area u5 during a period from te to tf. The time point ta is after the time point t12 where purging in the ejection area u1 ends. The time point tb is after the time point t22 where purging in the ejection area u2 ends. The time point tc is after the time point t32 where purging in the ejection area u3 ends. The time point td is after the time point t42 where purging in the ejection area u4 ends. The time point te is later than the time point t52 where purging in the ejection area u5 ends.

When the wiper 51 traverses each ejection opening 108, the ink retained nearby the relevant ejection opening 108 on the ejection face 2*a* is removed by the wiper 51. That is, for each ejection opening 108, the amount of ink retained on the ejection face 2*a* becomes zero when the wiper 51 traverses the relevant ejection opening 108. Then, when the wiper 51 passes the downstream end of the ejection area (u1 to u5), the amount of ink retained nearby each ejection opening 108 in the ejection area (u1 to u5) becomes zero.

As is understood from the above, supply of ink to an inflow passage (78*a* to 78*e*) related to an ejection area (u1 to u5) is completed before the wiper 51 starts wiping the relevant ejection area (u1 to u5). Then, while the wiper 51 passes the ejection area (u1 to u5) and wipes the ink thereon, the ink retained nearby each ejection opening 108 in the relevant ejection area (u1 to u5) of the ejection face 2*a* is being sucked back into the nozzle 131. When the wiper 51 traverses each ejection opening 108, a meniscus of ink is formed at the relevant ejection opening 108.

At any time point where the wiper 51 traverses an ejection opening 108, the amount of ink retained nearby the relevant ejection opening 108 on the ejection face 2*a* equals to a predetermined amount Vmin or more. This is equivalent to the amount of ink retained nearby each ejection opening 108 at the downstream end of an ejection area on the ejection face 2*a* being the predetermined amount Vmin or more, when the wiper 51 passes the downstream end of the ejection area (u1 to u5); i.e., the time point tb for the ejection area u1, the time point tc for the ejection area u2, the time point td for the ejection area u3, the time point to for the ejection area u4, and the time point tf for the ejection area u5. From another aspect, the drive period (T1, T2) of the pump 72 and the moving speed of the wiper 51 are determined by the control device 16 so that, where the rotating speed of the pump 72 is the above mentioned constant value, the amount of ink retained nearby each ejection opening 108 at the downstream end of an ejection area (u1 to u5) on the ejection face 2*a* is the predetermined amount Vmin or more, when the wiper 51 passes the downstream end of that ejection area (u1 to u5).

In the present embodiment, the predetermined amount Vmin equals to a volume (e.g. 20 to 50 pl) of the nozzle 131 (area of the individual ink passage 132 in the nozzle plate 130) formed on the nozzle plate 130. This is determined in consideration that ink is more easily thickened and foreign materials are more easily accumulated in the nozzle 131, compared to the upstream thereof. Alternatively, the predetermined amount Vmin may surpass the volume of the nozzle 131, or be less than the volume of the nozzle 131. In the present embodiment, the time required for the wiper 51 to pass the ejection area u1 or u5 is shorter than the time required for the wiper 51 to pass any of the ejection areas u2 to u4. Therefore, the amount of ink Va (>Vmin) retained nearby each ejection opening 108 at the downstream end of the ejection area u1 or u5 when the wiper 51 traverses the relevant ejection opening 108 is greater than the amount of ink Vb (=Vmin) retained nearby each ejection opening 108 at the downstream end of any of the ejection areas u2 to u4 when the wiper 51 traverses the relevant ejection opening 108.

The ink removed by the wiper 51 flows along the slope of the wiper 51, and reaches the discharge guide 56. The ink is then discharged to the waste ink tray 62 along the slope of the discharge guide 56. When the wiper 51 passes the five ejection areas u1 to u5, the wipe operation to the ejection face 2*a* is completed.

When the wipe operation is completed, the maintenance unit controller 83 controls the maintenance motor 34 to move the X-stage 31 further leftward in FIG. 11D so that the waste ink tray 62 is disposed in the standby position, and the head position controller 82 controls the elevation mechanism to move the ink-jet heads 1 to the printing position. Thus, the maintenance is completed. If printing is performed subsequently, the sheet P is conveyed. If the operation is to be ended, the apparatus stops after covering each ejection face 2*a* by a not-illustrated cap.

The following briefs a case of proceeding to the printing process. When the above-mentioned maintenance is complete, the open/close valves 79*a* to 79*e* are all in the open state. Further, the pump 72 is stopped, and the diversion valve 73 does not have any passage communicating the supply port 73*f* to any one of the five outlet ports 73*a* to 73*e*. Note that the pump 72 is stopped in such a manner that ink is able to pass inside the pump, as is already mentioned.

When the control device 16 recognizes the completion of the maintenance process or a request of the printing process, the control device 16 controls the head controller 81 to start conveying the sheet P and control the purge controller 84 to move the rotator 48 with the not-illustrated actuator to the whole supply position where the rotator 48 separates from the wall 45*c* of the casing 45. This forms passages from the supply port 73*f* to the five outlet ports 73*a* to 73*e* in the diversion valve 73, and ink not pressurized by the pump 72 is smoothly supplied from the ink tank 70 to the ink-jet head 1. At this point, the open/close valves 79*a* to 79*e* are in either the open state or the closed state. However, the present embodiment deals with a case where the purge controller 84 is controlled to maintain the open state for the sake of improving the ability of supplying ink.

The following briefs a case of proceeding to an operation shutdown process. When the control device 16 recognizes a request for stopping all the operations, the control device 16 performs a capping operation, turns the open/close valves 79*a* to 79*e* to the closed state, and controls the purge controller 84 to maintain the state in which no passage communicating the supply port 73*f* and any of the five outlet ports 73*a* to 73*e* is formed in the diversion valve 73.

In the maintenance operation of the present embodiment thus described hereinabove, ink discharged from the ejection openings 108 and retained on an ejection face 2*a* without dropping from the ejection face 2*a* is removed by the wiper 51 from the ejection face 2*a*. The amount of ink discharged from ejection openings 108 in the purge operation therefore is reduced. Further, a predetermined amount of ink (Vmin in the present embodiment) is removed by the wiper 51. The thickened ink, air bubbles, or foreign materials are reliably discharged from the ejection openings.

Further, the wiper 51 wipes the five ejection areas u1 to u5 in sequence corresponding to the sequence of supplying ink to the five ejection areas u1 to u5. Therefore, an ejection area (u1 to u5) is wiped with the wiper 51, immediately after the ink is discharged from the ejection openings 108 in the relevant ejection area (u1 to u5). Thus, it is possible to shorten the period from the point of completing discharging of ink from the ejection openings 108 to the point of removing with the wiper 51 the ink discharged from the ejection openings 108. With this, even if the drive period (T1, T2) of the pump 72 is shortened, it is possible to adjust the amount of ink retained nearby each ejection opening 108 at the downstream end of an ejection area (u1 to u5) when the wiper 51 passes the downstream end of that ejection area (u1 to u5). In short, it is possible to shorten the maintenance operation by means of shortening the drive period of the pump 72. Further, the amount of discharged ink sucked back into the nozzle 131 is reduced. This reduces the amount of once-discarded ink with higher possibility of being contaminated by foreign materials being used for printing.

Further, supplying of ink to the inflow passage (78*a* to 78*e*) relating to the ejection area (u1 to u5) is completed before the wiper 51 starts wiping the relevant ejection area (u1 to u5). Therefore, pressurized ink is not discharged from the ejection openings 108, after the ejection area (u1 to u5) are wiped by the wiper 51. This keeps the ejection face 2*a* from being contaminated. Such an effect is made even more effective by controlling the five open/close valves 79*a* to 79*e* so as to generate a negative pressure corresponding to the difference in the hydraulic head between the ink-jet head 1 and the ink tank 70 immediately after wiping of the corresponding ejection area (u1 to u5).

Additionally, in the purge operation, the longer the ejection area (u1 to u5) related to an inflow passage (78*a* to 78*e*) in the wiping direction is, the longer a period for supplying the pressurized ink to the inflow passage is. Thus, the amount of ink discharged from each ejection opening 108 until the end of the drive period is equalized among all the ejection areas u1 to u5. Therefore, the thickened ink, air bubbles, or foreign materials are reliably discharged from the ejection openings.

Further, the supply mechanism 69 includes: the pump 72, the diversion valve 73, the connection tube 71 communicating with the ink tank 70 and the diversion valve 73, and the five supply tubes 74. The diversion valve 73 communicates the connection tube 71 with one of the supply tubes 74 in sequence corresponding to the arrangement of the five ejection areas u1 to u5. Thus, a simply structured supply mechanism 69 is realized.

Further, since the predetermined amount Vmin equals to the volume of the nozzle 131, ink inside the nozzle 131 which is easily thickened is effectively discharged.

Second Embodiment

Figure 13:
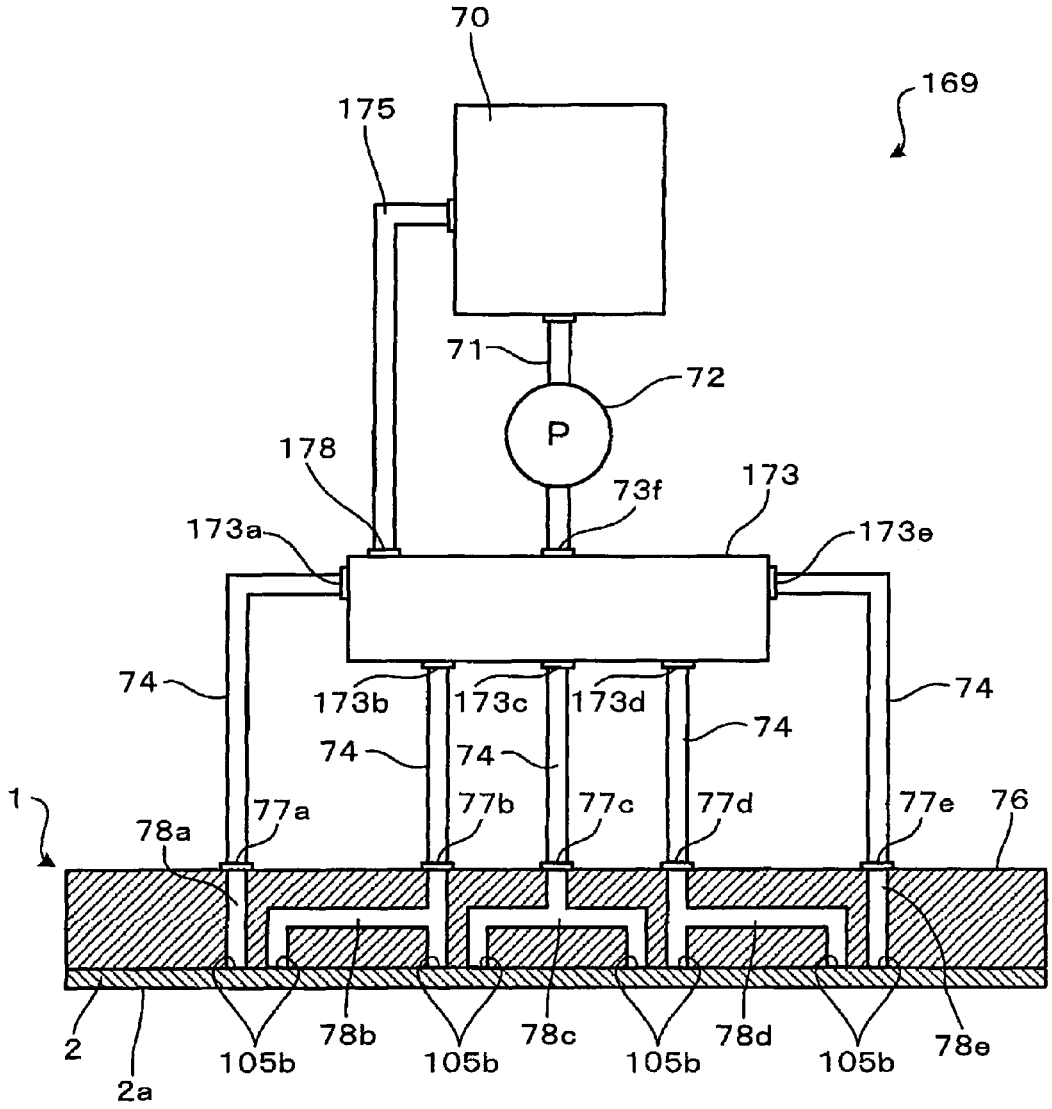
FIG. 13 is a schematic structure of a supply mechanism in an ink-jet printer of the second embodiment, according to the present invention.

Next, with reference to FIG. 13, the following describes a second embodiment of the present invention. The present embodiment only differs from the first embodiment in the structure of the supply mechanism. The following description therefore mainly deals with the supply mechanism, in particular, the diversion valve. Further, the same reference numerals are given to the members and functional parts that are substantially identical to those of the first embodiment, and no further description for these members and functional parts are given below.

As illustrated in FIG. 13, the supply mechanism 169 includes a pump 72, a diversion valve 173, two connection tubes 71 and 175, and five supply tubes 74. The diversion valve 173 includes a supply port 73*f* to which ink is supplied. To the supply port 73*f* is connected an ink tank 70 via the connection tube 71. The diversion valve 173 also includes a connection port 178 connected to the ink tank 70 via the connection tube 175. Further, the diversion valve 173 includes five outlet ports 173*a* to 173*e* which discharge ink. These outlet ports 173*a* to 173*e* are connected to inflow ports 77*a* to 77*e* of a reservoir unit 76 via the supply tube 74, respectively. Note that the positions of the outlet ports 173*a* to 173*e*, and the connection port 178, and the supply port 73*f* in FIG. 13 are different from the positions in FIG. 14, FIG. 16A, FIG. 16B, FIG. 17A, FIG. 17B, FIG. 18A, and FIG. 18B for the sake of convenience in illustration.

Figure 14:
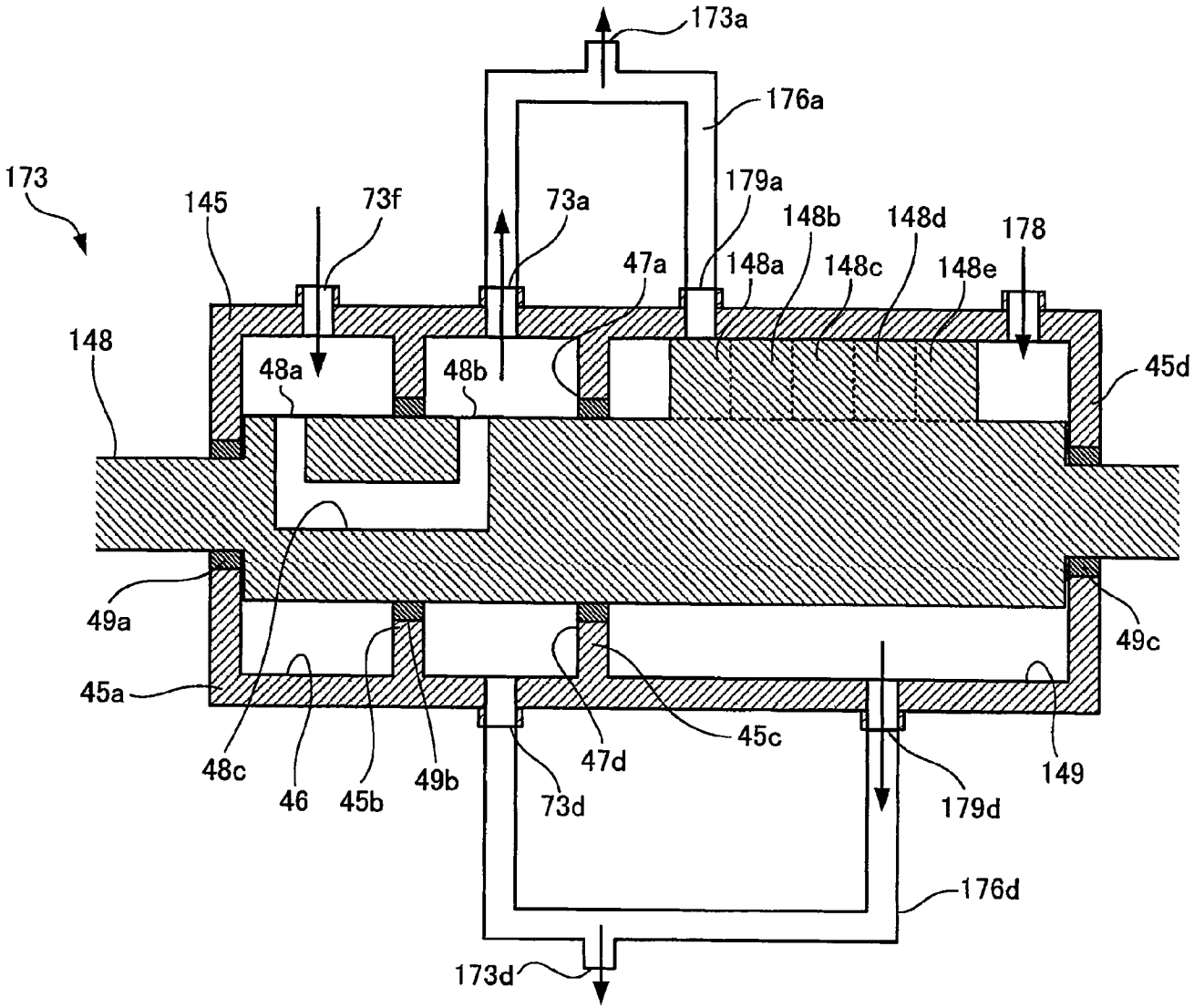
FIG. 14 is a cross sectional view of a diversion valve in the supply mechanism illustrated in FIG. 13.
Figure 15:
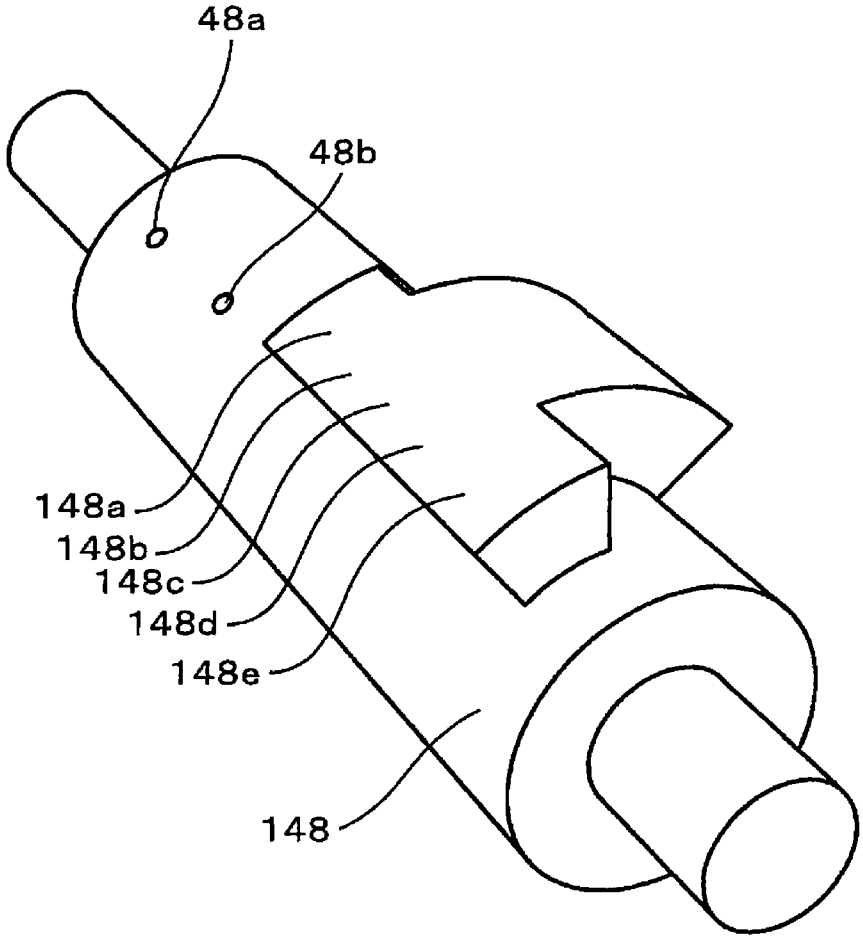
FIG. 15 is a perspective view of a rotator disposed inside the diversion valve illustrated in FIG. 14.

As illustrated in FIG. 14, the diversion valve 173 has a casing 145 having a cylindrical shape extending in one direction, a rotator 148 having a cylinder shape penetrating the casing 145 in the axial direction, and five communication tubes 176*a* to 176*e* (FIG. 14 only illustrates two communication tubes 176*a* and 176*e*). The rotator 148 is a passage switching member disposed inside the casing 145. Further, inside the casing 145, a first chamber 46, six second chambers 47*a* to 47*f*, and a first chamber 149 are formed in this order from the left side. These chambers are separated by the walls 45*b* and 45*c* provided to the casing 45. The first chamber 46 is a cylindrical space on the left side of the casing 145, and the inside inner circumference thereof is the outer circumference of the rotator 148. The first chamber 46 is in communication with the pump 72 and the ink tank 70 via the supply port 73*f* formed on the outer circumference of the casing 145.

Each of the six second chambers 47*a* to 47*f* is a space having a fan-shaped transection. The six second chambers 47*a* to 47*f* are arranged in this order in the circumferential direction about the center axis of the casing 145. Of these six second chambers 47*a* to 47*f*, five second chambers 47*a* to 47*e* are in communication with the exterior, via the connection ports 73*a* to 73*e* formed outside the casing 145, respectively. The second chamber 47*f* is not in communication with a passage outside the diversion valve 173.

Figure 16A:
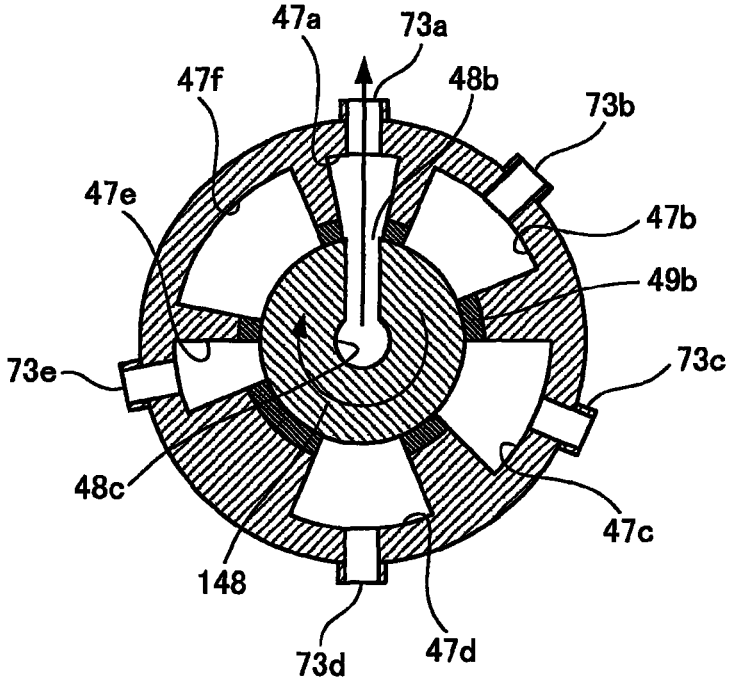
FIG. 16A, FIG. 16B, FIG. 17A, FIG. 17B, FIG. 18A and FIG. 18B are cross sectional views of the diversion valve for explaining the operation of the diversion valve in the second embodiment of the present invention.
Figure 16B:
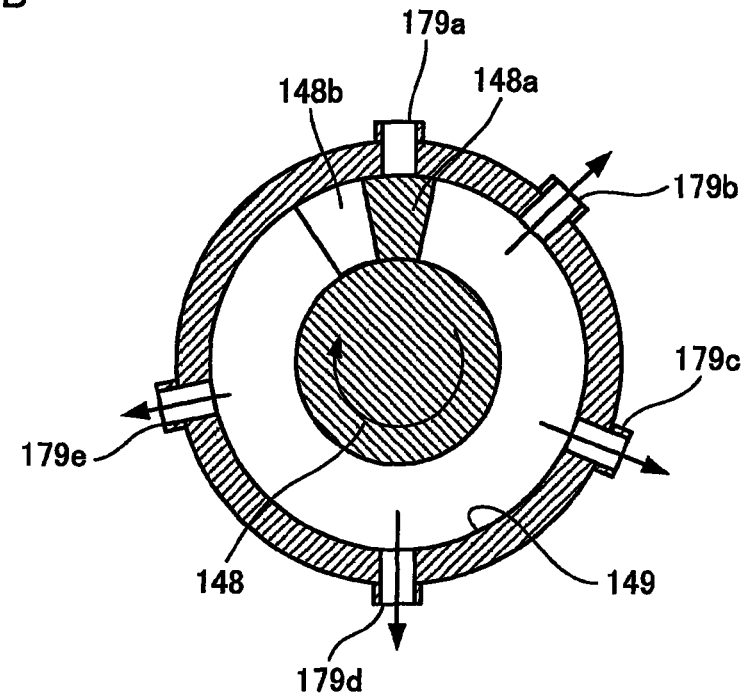

The third chamber 149 has a cylindrical shape. The third chamber 149 communicates with the outside via the connection ports 179*a* to 179*e* and the connection port 178 formed on the outer circumference of the casing 145. The connection ports 179*a* to 179*e* are arranged in this order in the axial direction. At the same time, the positions of the connection ports 179*a* to 179*e* in the circumferential direction of the casing 145 are the same as those of the connection ports 73*a* to 73*e*, as illustrated in FIG. 16A and FIG. 16B. Note that, for the sake of easier understanding, FIG. 16A and the subsequent figures provides illustration showing all the connection ports 73*a* to 73*e* or the connection port 179*a* to 179*e* in a cross section perpendicularly crossing the center axis of the casing 145.

The communication tubes 176*a* to 176*e* connect, outside the casing 145, the connection ports 73*a* to 73*e* connected to the second chamber 47*a* to 47*e* and the connection ports 179*a* to 179*e* connected to the third chamber 149. Further, at intermediate portions of the communication tube 176*a* to 176*e* are formed outlet ports 173*a* to 173*e* which discharges ink, respectively. The positions of the outlet ports 173*a* to 173*e* in the circumferential direction of the casing 145 are the same as those of the connection ports 179*a* to 179*e* and the connection port 73*a* to 73*e*, respectively. FIG. 14 only illustrates the communication tubes 176*a* and 176*d*; however, the communication tube 176*b* to 176*c*, and 176*e* are also structured in the same manner.

To an opening provided on a wall 45*d* on the right side of the casing 145 in FIG. 14 is attached a bearing 49*c*. The rotator 148 is disposed so as to share the same axis with the casing 45. This rotator 148 is supported by the bearings 49*a* to 49*c* and therefore is capable of rotate about the center axis of the casing 145. Further, the rotator 148 always abuts the inner surfaces of the walls 45*a* and 45*d*, and is not able to move in the axial direction. The rotator 148 has a communication path 48*c*. Two ends of the communication path 48*c* communicate with openings 48*a* and 48*b* formed on the outer circumference of the rotator 148 respectively. The direction of communicating with the two openings 48*a* and 48*b* coincides with the axial direction of the rotator 148. The opening 48*b* faces one of the six second chambers 47*a* to 47*f*, according to the rotation position of the rotator 148. Accordingly, the communication path 48*c* communicates the first chamber 46 with any one of the six second chambers 47*a* to 47*f* according to the rotation position of the rotator 148.

On the outer circumference of an area of the rotator 148 in the third chamber 149 are formed five projections 148*a* to 148*e* each having a fan-shaped transection. These projections 148*a* to 148*e* are integrally formed with the rotator 148 in the axial direction of the rotator 148. The projections 148*a* to 148*e* project in a radial direction of the rotator 148. The positions of the projections 148*a* to 148*e* in the axial direction are the same as those of the connection ports 179*a* to 179*e*. Regarding the position of the connection port 48*b* in the circumferential direction as one end, all the projections 148*a* to 148*e* extend in a direction opposite to the rotate direction of the rotator 148 (see arrows of FIG. 16B) from that one end. The outer circumferences of the projections 148*a* to 148*e* entirely abut the inner circumference of the third chamber 149. The length of each projection (148*a* to 148*e*) in the circumferential direction is substantially the same as the length of the surface of the outer inner wall of the corresponding second chamber (47*a* to 47*e*). That is, the projections 148*b*, 148*c*, 148*d* each has a length which is twice the length of the projection 148*a* and 148*e* in the circumferential direction. Therefore, when the rotator 148 rotates, the connection ports 179*a* to 179*d* sequentially faces the corresponding projections 148*a* to 148*e*. With the rotation of the rotator 148, the projections 148*a* to 148*e* sequentially blocks the communication between the third chamber 149 and the second chamber (47*a* to 47*e*) via the connection ports 179*a* to 179*e* and the communication tubes 176*a* to 176*e*. This prevents the flow of ink via the connection ports 179*a* to 179*e*. On the other hand, the connection port 178 is formed in a position not sealed by the projections 148*a* to 148*e*. Therefore, the third chamber 149 is in communication with the ink tank 70 via the connection port 178.

Next, an operation of the diversion valve 173 is detailed. As illustrated in FIG. 16A and FIG. 16B, during a period of "selective supply position A" where the connection port 48*b* of the rotator 148 faces the second chamber 47*a*, the connection port 179*a* out of the five connection ports 179*a* to 179*e* faces the projection 148*a*, thus blocking flowing in/out of ink via the connection port 179*a*. At this time, the other connection ports 179*b* to 179*e* do not face the projections 148*b* to 148*e*. Thus, ink pressurized by the pump 72 is discharged from the outlet port 173*a*, via the supply port 73*f*, the first chamber 46, the communication path 48*c* of the rotator 148, the second chamber 47*a*, the connection port 73*a*, and the communication tube 176*a*. At this point, there is formed a passage from the ink tank 70 to the outlet port (173*b* to 173*e*) via the connection tube 175, the connection port 178, the third chamber 149, the connection port (179*b* to 179*e*), and the communication tube (176*b* to 176*e*). Therefore, ink having flown out from the ink tank 70 reaches the inflow passage (78*b* to 78*e*) via the outlet port (173*b* to 173*e*) and the supply tube 74, without going through the pump 72.

Figure 17A:
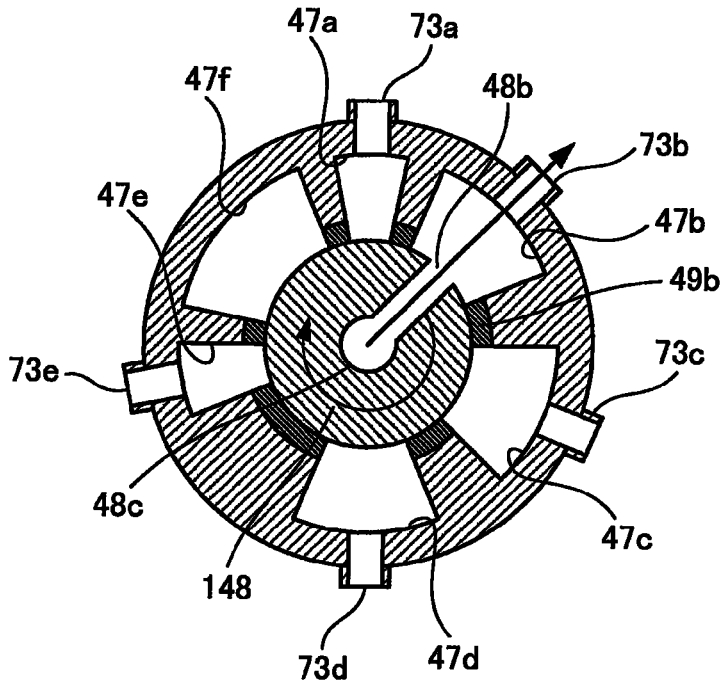
Figure 17B:
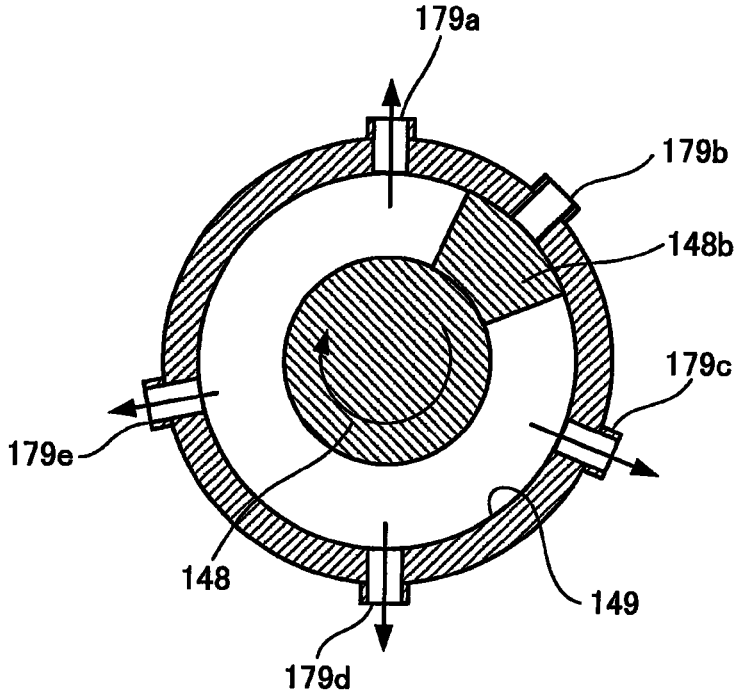

Further, as illustrated in FIG. 17A and FIG. 17B, in a period in which the rotator 148 is in the "selective supply position B" where the connection port 48*b* of the rotator 148 faces the second chamber 47*b*, as a result of rotating clockwise in FIG. 17A from the "selective supply position A", the connection port 179*b* out of the five connection ports 179*a* to 179*e* faces the projection 148*b*, thus blocking flowing in/out of ink via the connection port 179*b*. At this time, the other connection ports 179*a* and 179*c* to 179*e* do not face the projections 148*a* and 148*c* to 148*e*. Thus, ink pressurized by the pump 72 is discharged from the outlet port 173*b*, via the supply port 73*f*, the first chamber 46, the communication path 48*c* of the rotator 148, the second chamber 47*b*, the connection port 73*b*, and the communication tube 176*b*. At this time, there is formed a passage from the ink tank 70 to the outlet port (173*a*, 173*c* to 173*e*), via the connection tube 175, the connection port 178, the third chamber 149, the connection port (179*a*, 179*c* to 179*e*), and the communication tube (176*a*, 176*c* to 176*e*). Ink having flown out from the ink tank 70 reaches the inflow passage (78*a*, 78*c* to 78*e*) via the outlet port (173*a*, 173*c* to 173*e*) and the supply tube 74, without going through the pump 72.

Similarly, the rotator 148 further rotates clockwise in FIG. 17A from the "selective supply position B" thereby sequentially transits to: the "selective supply position C" where the connection port 48*b* faces the second chamber 47*c* and where the connection port 179*c* out of the five connection ports 179*a* to 179*e* faces the projection 148*c*; the "selective supply position D" where the connection port 48*b* faces the second chamber 47*d* and where the connection port 179*d* out of the five connection port 179*a* to 179*e* faces the projection 148*d*; and the "selective supply position E" where the connection port 48*b* faces the second chamber 47*e* and where the connection port 179*e* out of the connection port 179*a* to 179*e* faces the projection 148*d*. Thus, ink pressurized by the pump 72 is sequentially discharged from the outlet port 173*c* to the outlet port 173*e*.

Figure 18A:
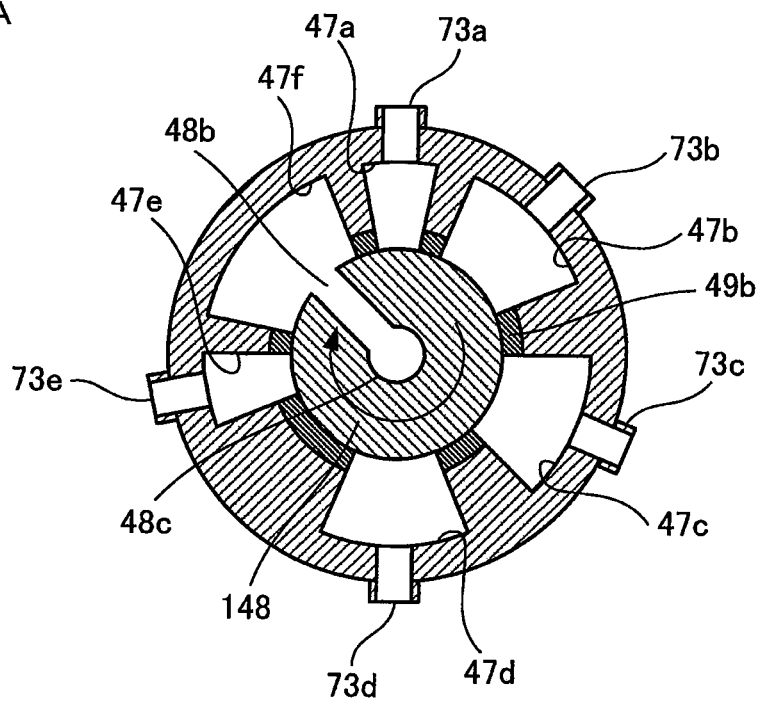
Figure 18B:
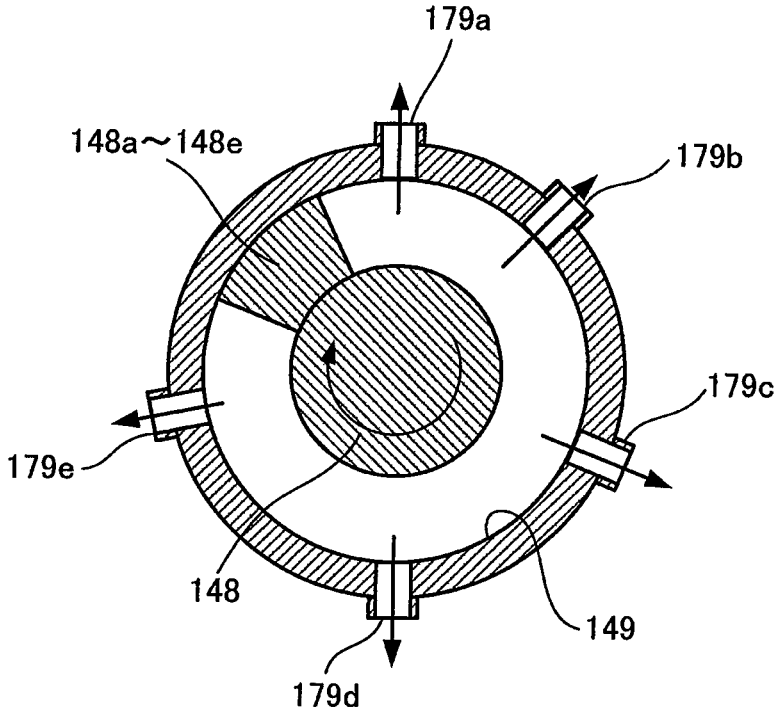

As illustrated in FIG. 18A, when the rotator 148 is in the "whole supply position" where the connection port 48*b* faces the second chamber 47*f*, the projections 148*a* to 148*e* do not face any of the connection ports 179*a* to 179*e*. At this time, there is formed a passage from the ink tank 70 to the five outlet ports 173*a* to 173*e* via the connection tube 175, the connection port 178, the third chamber 149, the connection ports 179*a* to 179*e*, and the communication tubes 176*a* to 176*e*. Therefore, the ink having flown out from the ink tank 70 reaches the inflow passages 78*a* to 78*e* via all the outlet ports 173*a* to 173*e* and the supply tube 74, without going through the pump 72.

The control device 16, at the time of printing, controls the not-illustrated actuator to rotate the rotator 48 thereby positioning the rotator 148 in the "whole supply position". Thus, ink not pressurized by the pump 72 is supplied to all the inflow passages 78*a* to 78*e* of the reservoir unit 76, via the two connection tubes 71 and 175, the diversion valve 173(the supply port 73*f*, the connection port 178, and the outlet ports 173*a* to 173*e*), and the five supply tubes 74. Ejection of ink droplets from the ink-jet heads 1 is then possible.

The control device 16, when the purge operation starts, drives the pump 72 to supply pressurized ink from the ink tank 70 to the first chamber 46 via the supply port 73*f* of the diversion valve 173, and controls the not-illustrated actuator to rotate the rotator 48 so that the rotator 48 sequentially moves from the "whole supply position"→the "selective supply position A"→the "selective supply position B"→the "selective supply position C"→the "selective supply position D"→and the "selective supply position E". Thus, ink pressurized by the pump 72 and forcedly supplied to the first chamber 46 is sequentially discharged from the outlet port 173*a*→the outlet port 173*b*→the outlet port 173*c*→the outlet port 173*d*→the outlet port 173*e*. In sync with this switching over, the projection (148*a* to 148*e*) and the connection port (179*a* to 179*e*) face each other, thereby blocking flowing in/out of ink via the connection port (179*a* to 179*e*). The ink having been sequentially discharged from the outlet ports 173*a* to 173*e* is forcedly supplied to inflow passages 78*a* to 78*e* in the following sequence: the inflow passage 78*a*→the inflow passage 78*b*→the inflow passage 78*c*→the inflow passage 78*d*→the inflow passage 78*e*. Accordingly, the ejection area (u1 to u5) with ejection openings 108 discharging ink pressurized by the pump 72 is switched in the sequence of ejection area u1→the ejection area u2→the ejection area u3→the ejection area u4→the ejection area u5 (see FIG. 12). At this time, the ink discharged does not drop and is retained on the ejection face 2*a* by the surface tension, as is the case of the foregoing first embodiment.

While the ejection area (u1 to u5) whose ejection openings 108 are discharging the pressurized ink is sequentially switched over, the inflow passage (78*a* to 78*e*) related to the ejection area (u1 to u5) of the ejection openings 108 not discharging the pressurized ink is in communication with the ink tank 70 via the third chamber 149 and the connection tube 175. Accordingly, a negative pressure corresponding to the difference in the hydraulic head between the ink-jet head 1 and the ink tank 70 acts on the ink in the ejection area (u1 to u5) related to the inflow passage (78*a* to 78*e*) communicating with the ink tank 70 via the third chamber 149 and the connection tube 175. Thus, in the ejection area (u1 to u5) with the ejection openings 108 not discharging ink, which area relates to the inflow passage (78*a* to 78*e*) communicating with the ink tank 70 via the third chamber 149 and the connection tube 175, the ink on the ejection face 2*a* is sucked back into the nozzle 131 due to the negative pressure.

The wipe operation of the present embodiment is the same as that of the first embodiment. That is, the maintenance unit controller 83 moves the X-stage 31 from the right side to the left side in FIG. 11D, so that the wiper 51, while the leading end thereof contacts the ejection face 2*a*, wipes each of the ejection areas u1 to u5 in this sequence in the wiping direction, in sync with switching of one of the five inflow passages 78*a* to 78*e* targeted for the ink supply. Further, no matter which one of the ejection openings 108 the wiper 51 is traversing, the amount of ink retained on the ejection face 2*a* nearby each ejection opening 108 equals to the predetermined amount Vmin (nozzle volume) or more.

In the maintenance operation of the present embodiment thus described, ink discharged from the ejection openings 108 does not drop from the ejection face 2*a* and is retained on the ejection face 2*a*. This ink is removed from the ejection face 2*a* by the wiper 51. Thus, the amount of ink discharged from the ejection openings 108 in the purge operation is reduced. Further, since the predetermined amount (Vmin in the present embodiment) of ink is removed by the wiper 51, it is possible to reliably discharge from the ejection openings the thickened ink, air bubbles, or foreign materials. Additionally, the effects achieved by the above-mentioned first embodiment are also achieved.

Further, there is no need for moving the rotator 148 of the diversion valve 173 to the axial direction. Simply rotating the rotator 148 enables switching of the ejection area (u1 to u5) of the ejection openings 108 discharging the ink. Thus, control of the diversion valve 173 is simplified and the cost reduction for the supply mechanism 169 is possible. Further, the present embodiment does not require the open/close valves 79*a* to 79*e*, and the number of supply tubes 75 can be reduced.

<Modifications>

Modifications of the above-mentioned embodiments are described below. In the above mentioned first and second embodiments, the supplying of ink to an inflow passage (78*a* to 78*e*) related to an ejection area (u1 to u5) is completed before the wiper 51 starts wiping the relevant ejection area (u1 to u5). However, the supplying of ink to the inflow passage (78*a* to 78*e*) related to the ejection area (u1 to u5) does not have to be completed at the time when the wiper 51 starts wiping the ejection area (u1 to u5). There should be no significant problem as long as the ink discharged after wiping with the wiper 51 does not drop and the entire amount of ink is retained on the ejection face 2*a* is sucked back into the nozzle 131 with elapse of time.

For all the ejection areas u1 to u5, when the wiper 51 traverses each ejection opening 108 at the downstream end of an ejection area (u1 to u5), the amount of ink retained nearby the relevant ejection opening 108 on the ejection face 2*a* may be equal (Va=Vb). It is preferable that Va=Vb=Vmin. With this, unnecessary discharging of ink is restrained. For example, this is achieved by setting the rotating speed of the pump 72 in relation to the ejection areas u1 and u5 slower than the rotating speed of the pump 72 in relation to the ejection areas u2 to u4. Alternatively, the drive period T1 may be shortened, or the moving speed of the wiper 51 at the time of passing the ejection areas u2 to u4 may be increased.

In the purge operation of the above-mentioned first and second embodiments, the diversion valve 73 is used to selectively and forcedly supply ink pressurized by a single pump 72 to the five passage blocks (inflow passages 78*a* to 78*e*). However, it may be ink pressurized by a plurality of pumps disposed in parallel to each other, which is forcedly supplied to the plurality of passage blocks. Such a structure allows ink supply to each passage block independently of the other passage blocks. The timing of supplying ink therefore can be designed more flexibly.

Additionally, in the above-mentioned first and second embodiments, five passage blocks are formed in the passage unit 9, and pressurized ink is forcedly supplied to the five passage blocks (inflow passages 78*a* to 78*e*) at different timings during the purge operation. However, a passage unit may have one, two, three, four, six or more passage blocks. In cases where the passage unit has a plurality of passage blocks, ink may be forcedly supplied to the plurality of passage blocks at the same timing in the purge operation.

Further, in the above-mentioned first and second embodiments, a single nozzle plate 130 forms the ejection face 2*a*. However, the ink-jet head may include a plurality of independent divided heads each corresponding to a passage block. With this, a long ink-jet heads is manufactured simply by assembling the separate heads. Further, the drive period (T1, T2) of the pump 72 may be determined on the premise that the rotating speed of the pump 72 is variable.

The recording head of the recording apparatus according to the present invention may be a recording head that ejects fluid other than ink. Further, application of such a recording head is not limited to printers, and the recording head is also applicable to facsimiles and photocopiers.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A recording apparatus, comprising:

a droplet ejection head extending in one direction, the droplet ejection head including an inflow passage having an inflow port through which a fluid flows into the inflow passage, a common fluid passage connected to the inflow passage, and a plurality of individual fluid passages each extending from an outlet of the common fluid passage to a corresponding ejection opening of a plurality of ejection openings formed on an ejection face via a pressure chamber;

a supply mechanism capable of forcibly supplying the fluid to the inflow passage;

a wiper formed of an elastic material;

a moving mechanism configured to move the wiper in the one direction while contacting the wiper to the ejection face; and a controller configured to control the supply mechanism and the moving mechanism, wherein the controller is configured to control the supply mechanism and the moving mechanism so that:

the fluid forcibly supplied to the inflow passage and discharged from each ejection opening does not drop from the ejection face, at least a predetermined amount of the fluid discharged from each of the ejection openings is retained on the ejection face, and a negative pressure acts on a relevant ejection opening when the wiper traverses the relevant ejection opening, wherein the at least a predetermined amount of fluid retained on the ejection face is sucked into the relevant ejection opening by the negative pressure.

2. The recording apparatus according to claim 1, wherein:

the droplet ejection head includes a plurality of inflow passages and a plurality of common fluid passages, each of the plurality of common fluid passages connected to at least one of the plurality of inflow passages different from other inflow passages to which other common fluid passages are connected;

the ejection face includes a plurality of ejection areas arranged in the one direction, each of the ejection areas including multiple ejection openings of the plurality of ejection openings, the multiple ejection openings corresponding to the plurality of individual fluid passages connected to one of the inflow passages; and the controller is configured to control the supply mechanism and the moving mechanism so that the fluid is supplied to the plurality of inflow passages in a sequence corresponding to the arrangement of the plurality of ejection areas on the ejection face, and so that the plurality of ejection areas are wiped by the wiper in the sequence corresponding to the arrangement, in synchronization with switching over from the one of the plurality of inflow passages targeted for the fluid supply.

3. The recording apparatus according to claim 2, wherein the controller is configured to control the supply mechanism and the moving mechanism so that the fluid supply to the one of the plurality of inflow passages is completed before the wiper starts wiping an ejection area corresponding to the one of the plurality of inflow passages.

4. The recording apparatus according to claim 2, wherein:

the plurality of ejection areas are distinguishable into two or more groups by a length of each ejection area in the one direction; and the controller is configured to control the supply mechanism so that the longer an ejection area is, the longer a period for supplying fluid to the inflow passage is.

5. The recording apparatus according to claim 2, wherein:

the supply mechanism includes:

a plurality of supply passages, each having one end connected to the inflow port, a valve having a plurality of outlet ports, each connected to another end of a corresponding one of the plurality of supply passages and a supply port to which the fluid is supplied, and a pump configured to supply the fluid to the supply port; and the controller is configured to control the valve so that a passage from the supply port to one of the plurality of outlet ports is formed in the pump in the sequence corresponding to the arrangement, and in synchronization with the movement of the wiper.

6. The recording apparatus according to claim 5, wherein:

the supply mechanism further includes an ink tank connected to the pump; and the controller is configured to control the supply mechanism so that the negative pressure acts on the relevant ejection opening due to a difference in hydraulic heads between the droplet ejection head and the ink tank when the wiper traverses the relevant ejection opening.

7. The recording apparatus according to claim 2, wherein:

the controller is configured to control the supply mechanism and the moving mechanism so that, when the wiper traverses one or more ejection openings at the downstream end of any one of the plurality of ejection areas, a same amount of the fluid is retained on the ejection face in relation to ejection openings of any of the plurality of ejection areas.

8. The recording apparatus according to claim 1, wherein:

the droplet ejection head is a stack of a plurality of plates including a nozzle plate having a nozzle with an ejection opening, the nozzle being a through hole in the thickness direction formed as a part of each of the individual fluid passages; and the predetermined amount corresponds to the volume of the nozzle.

* * * * *